US012570908B2

(12) United States Patent
Li et al.

(10) Patent No.: US 12,570,908 B2
(45) Date of Patent: Mar. 10, 2026

(54) METHOD FOR SELECTIVE HYDROGENATION OF BUTADIENE EXTRACTION TAIL GAS AND SELECTIVE HYDROGENATION APPARATUS THEREOF

(71) Applicants: CHINA PETROLEUM & CHEMICAL CORPORATION, Beijing (CN); BEIJING RESEARCH INSTITUTE OF CHEMICAL INDUSTRY, CHINA PETROLEUM & CHEMICAL CORPORATION, Beijing (CN)

(72) Inventors: Yan Li, Beijing (CN); Jun Tian, Beijing (CN); Dongfeng Li, Beijing (CN); Liang Guo, Beijing (CN); Chunfang Li, Beijing (CN); Yi Yue, Beijing (CN); Zhou Du, Beijing (CN); Zhan Shu, Beijing (CN); Shujuan Luo, Beijing (CN); Jieming Ye, Beijing (CN); Ting Cui, Beijing (CN)

(73) Assignees: CHINA PETROLEUM & CHEMICAL CORPORATION, Beijing (CN); BEIJING RESEARCH INSTITUTE OF CHEMICAL INDUSTRY, CHINA PETROLEUM & CHEMICAL CORPORATION, Beijing (CN)

( * ) Notice: Subject to any disclaimer, the term of this patent is extended or adjusted under 35 U.S.C. 154(b) by 425 days.

(21) Appl. No.: 18/033,871

(22) PCT Filed: Oct. 19, 2021

(86) PCT No.: PCT/CN2021/124668
§ 371 (c)(1),
(2) Date: Apr. 26, 2023

(87) PCT Pub. No.: WO2022/089250
PCT Pub. Date: May 5, 2022

(65) Prior Publication Data

US 2024/0076559 A1 Mar. 7, 2024

(30) Foreign Application Priority Data

Oct. 26, 2020 (CN) ..... 202011156909.8
Oct. 26, 2020 (CN) ..... 202011158575.8
Oct. 26, 2020 (CN) ..... 202011158581.3

(51) Int. Cl.
*C10G 45/32* (2006.01)
*C10G 5/06* (2006.01)

(52) U.S. Cl.
CPC ..... *C10G 45/32* (2013.01); *C10G 5/06* (2013.01); *C10G 2300/1092* (2013.01); (Continued)

(58) Field of Classification Search
CPC ..... C10G 47/34; C10G 45/04; C10G 2300/1044; C10G 2300/202; (Continued)

(56) References Cited

U.S. PATENT DOCUMENTS 5,877,363 A 3/1999 Gildert et al.
2018/0171246 A1 6/2018 Axens

FOREIGN PATENT DOCUMENTS

CN 101993323 A 3/2011
CN 102240547 11/2011
(Continued)

OTHER PUBLICATIONS

English translation for CN 108863697 (Year: 2018).*
International Search Report and Written Opinion in counterpart PCT Application No. PCT/CN2021/124668, mailed Jan. 14, 2022.

*Primary Examiner* — Prem C Singh
*Assistant Examiner* — Juan C Valencia
(74) *Attorney, Agent, or Firm* — FINNEGAN, HENDERSON, FARABOW, GARRETT & DUNNER LLP

(57) ABSTRACT

The present invention belongs to the field of petrochemical industry, and discloses a method for selective hydrogenation of butadiene extraction tail gas and a selective hydrogena- (Continued)

tion apparatus thereof. The method for selective hydrogenation of butadiene extraction tail gas comprises: (1) an alkyne-containing tail gas from a butadiene extraction unit is fed into a raw material tank, optionally impurities entrained in the alkyne-containing tail gas are removed before being fed into the raw material tank; (2) a C4 raw material in the raw material tank is pressurized by a feed pump to a pressure required for reaction, then merged with a circulated C4 stream from a first-stage reactor outlet buffer tank and fed into a first-stage mixer, wherein it is mixed with hydrogen gas, and fed into the first-stage reactor to undergo a first-stage hydrogenation reaction, and a first-stage reaction stream obtained by the reaction is fed into the first-stage reactor outlet buffer tank; the hydrogen gas required for the reaction in the first-stage reactor is fed through a first feeding mode or a second feeding mode: the first feeding mode comprises: all the hydrogen gas required for the reaction is fed through the first-stage reactor outlet buffer tank, and then fed into the first-stage reactor through a first route at an outlet of the first-stage reactor outlet buffer tank; the second feeding mode comprises: a part of the hydrogen gas required for the reaction is fed through the first-stage reactor outlet buffer tank, and then fed into the first-stage reactor through the first route at an outlet of the first-stage reactor outlet buffer tank; and the other part of the hydrogen gas is fed through the first-stage mixer, and then fed into the first-stage reactor; (3) there is no gas-phase discharge from the first-stage reactor outlet buffer tank, and a liquid-phase product is divided into at least two streams, the first stream is returned to the first-stage reactor as the circulated C4 stream, and the second stream is used as a feed to a stabilization tower or subjected to further hydrotreatment prior to being fed into the stabilization tower; (4) a C4 hydrogenation product is recovered after separation in the stabilization tower.

20 Claims, 3 Drawing Sheets

(52) U.S. Cl.
CPC ..... *C10G 2300/4006* (2013.01); *C10G 2300/4012* (2013.01); *C10G 2300/4018* (2013.01); *C10G 2300/802* (2013.01)

(58) Field of Classification Search
CPC .. C10G 2400/04; C08G 63/66; C08G 63/183; C08G 63/197; C10L 1/08
See application file for complete search history.

(56) References Cited

FOREIGN PATENT DOCUMENTS

| | | | | | |
|---|---|---|---|---|---|
| CN | 102285859 | A | | 12/2011 | |
| CN | 102285860 | A | | 12/2011 | |
| CN | 102336626 | A | | 2/2012 | |
| CN | 102886262 | | | 1/2013 | |
| CN | 103121905 | A | | 5/2013 | |
| CN | 103787811 | A | | 5/2014 | |
| CN | 103787815 | A | | 5/2014 | |
| CN | 104707622 | | | 6/2015 | |
| CN | 105566032 | A | | 5/2016 | |
| CN | 105585411 | A | | 5/2016 | |
| CN | 108863697 | A | * | 11/2018 | ..... C07C 5/05 |
| CN | 109485536 | A | | 3/2019 | |
| CN | 109806885 | A | | 5/2019 | |
| EP | 1217060 | A1 | | 6/2002 | |
| RU | 2163589 | C2 | | 2/2001 | |
| RU | 2750319 | C2 | | 6/2019 | |

* cited by examiner

METHOD FOR SELECTIVE HYDROGENATION OF BUTADIENE EXTRACTION TAIL GAS AND SELECTIVE HYDROGENATION APPARATUS THEREOF

CROSS-REFERENCE TO RELATED APPLICATION

This is a national stage application of International Application No. PCT/CN2021/124668, filed Oct. 19, 2021, which claims priority to and benefits of Chinese Patent Application Nos. 202011158575.8, 202011158581.3, and 202011156909.8, filed Oct. 26, 2020, all of which are incorporated herein by reference.

TECHNICAL FIELD

The present invention relates to the field of petrochemical industry, in particular to a method for selective hydrogenation of butadiene extraction tail gas and a selective hydrogenation apparatus thereof.

BACKGROUND ART

At present, butadiene extraction unit generally recovers 1,3-butadiene from a cracked C4 fraction of an ethylene unit through two-stage extractive distillation and ordinary distillation, and at the same time produces a by-product tail gas rich in alkynes and dienes. Due to the different technologies used in the butadiene extraction unit, the by-product alkynes-containing tail gas may be in two different states, i.e., liquid phase and gas phase, but the common feature thereof is relatively high concentration of vinyl acetylene (VA) and ethyl acetylene (EA) in the tail gas, in which the VA content is usually 20%, up to 40 wt %. At present, in order to ensure safety, this tail gas rich in alkynes and dienes needs to be diluted with C4 raffinate, and then sold as liquefied gas, or directly discharged to the flare for combustion. If the tail gas is recycled and utilized, it will create good economic and social benefits.

At present, for the C4 resources rich in alkynes and dienes, the industry mainly converts them into high value-added products through hydrofining, in which one method used is selective hydrofining. Although hydrogenation activity of unsaturated hydrocarbons increases with the degree of unsaturation, and alkynes in the C4 components react with hydrogen gas preferentially over diolefins and monoolefins, the diolefins and monoolefins in the C4 components can also react violently with hydrogen gas at lower temperatures to form alkanes under the action of a catalyst. The selective hydrogenation reaction of C4 components is a three-phase reaction of gas, liquid and solid. However, due to small amount of hydrogen gas required for the reaction, hydrogen gas is limited to dissolve in C4 components, and then reacts with reactants such as alkynes and dienes in C4 components by mass transfer through the liquid membrane to the surface of catalyst. The inventors have found that hydrogenation reaction is limited by hydrogen gas, that is, on the surface of a catalyst, where hydrogen gas is insufficient, the alkynes cannot undergo the hydrogenation reaction, and thus hardly can be completely removed from the product, and polymerization reaction thereof is prone to occur to generate heavy components that may reduce the performance of the catalyst; and where hydrogen gas is excess, the diolefins and butenes produced by the hydrogenation reaction of alkynes may further undergo hydrogenation reactions to form alkenes and alkanes, resulting in a decrease in the selectivity of the hydrogenation reaction of alkynes.

CN102285859A discloses a method for selective hydrogenation of C4 streams, wherein by using palladium-silver two-component or palladium-silver multi-component catalysts with alumina as a carrier, the C4 streams with high butadiene content undergoes selective hydrogenation to obtain a product rich in 1-butene and having the content of butadiene and alkyne of less than 10 ppm, which can be used as a raw material of MTBE plant. However, this patent does not involve a butadiene tail gas rich in vinyl acetylene (VA) and ethyl acetylene (EA), and hydrogen gas is directly allocated at the reactor inlet, the distribution of which is easily affected by the equipment and pipeline layout, so that it is difficult to ensure uniform distribution of hydrogen, which in turn limits selectivity of the catalyst.

CN103121905A discloses a recovering method for butadiene extraction tail gas, wherein by adopting a nickel-palladium-copper-silver multi-metal catalyst, alkynes undergo selectively hydrogenation to obtain a product rich in butadiene, which is sent to a butadiene unit for further recovery of butadiene. In this method, hydrogen gas is directly fed at the reactor inlet, the distribution of which is easily affected by equipment and pipeline layout, so that it is difficult to ensure uniform distribution of hydrogen, which in turn limits selectivity of the catalyst. In addition, since heavy components such as polymers produced by the selective hydrogenation reaction are not removed from the hydrogenated C4 stream that is used to dilute raw material, they may easily accumulate in the system, resulting in a reduced performance and life of the catalyst.

CN108863697A discloses a method for recovering butadiene by selective hydrogenation of alkynes, wherein by adopting a palladium-molybdenum selective hydrogenation catalyst, after hydrogenation of alkynes in the C4 stream, the vinyl acetylene content is lower than 1.0 wt %, the butadiene selectivity is higher than 46%, and the product meets the feed requirements of the butadiene extraction unit. However, this patent uses a noble-metal-containing palladium catalyst and thus has a high cost, and it does not involve a process of selective hydrogenation unit for butadiene tail gas.

CN103787811A discloses a method for utilizing butadiene tail gas, wherein a Ni-based catalyst with a titanium oxide-alumina composite as carrier are adopted to hydrogenate all alkynes, dienes and monoenes in the tail gas, resulting in the product with the content of olefins of less than 5%, which can be used as raw material for cracking in ethylene plant, but this patent does not involve the field of selective hydrogenation.

CN109806885A discloses a Pdx/Cu single-atom catalyst for selective hydrogenation of C4 stream and its preparation method. After unsaturated olefins in C4 stream undergo hydrogenation, selectivity of total butenes is greatly improved, but the reaction temperature is relatively higher, resulting in more energy consumption; in addition, it does not disclose the process flow.

In recent years, there have been many researches on C4-component selective hydrogenation catalysts, and activity and selectivity of the catalysts have been greatly improved. However, as mentioned above, inaccurate control and uneven distribution of hydrogen gas severely limit the selectivity of the catalysts, making it difficult for the selective hydrogenation reaction to simultaneously meet the requirements of high conversion of alkynes and dienes and high yield of monoolefins. Compared with small pilot plants in the laboratory, in actual industrial plants, production scale has increased by a hundred times, precise control of hydrogen gas is more difficult and distribution of hydrogen gas is more uneven. According to characteristics of the industrial plants, it is more necessary to improve conditions of selective hydrogenation reaction in terms of process and control.

Therefore, there is still a need for a method for selective hydrogenation of butadiene extraction tail gas and a selective hydrogenation apparatus thereof, which can promote the even distribution of hydrogen gas during the selective hydrogenation reaction, improve the selectivity of the selective hydrogenation reaction, and prolong the service life of the catalyst.

Contents of the Present Invention

The object of the present invention is to provide a method for selective hydrogenation of butadiene extraction tail gas and a selective hydrogenation apparatus thereof to solve the defects in the prior art. By improving the method for allocating and metering the hydrogen gas required for the selective hydrogenation reaction, the problem of uneven distribution of reactor temperature caused by uneven distribution of hydrogen, which in turn leads to a decrease in the selectivity of the hydrogenation reaction, can be solved. While ensuring the accurate metering of hydrogen, it promotes the even distribution in the selective hydrogenation reaction, improves the selectivity of the selective hydrogenation reaction, reduces the occurrence of side reactions, and prolongs the service life of the catalyst.

In order to achieve the above object, one aspect of the present invention provides a method for selective hydrogenation of butadiene extraction tail gas, characterized in that the selective hydrogenation method comprises:

(1) an alkyne-containing tail gas from a butadiene extraction unit is fed into a raw material tank, optionally impurities entrained in the alkyne-containing tail gas are removed before being fed into the raw material tank;

(2) a C4 raw material in the raw material tank is pressurized by a feed pump to a pressure required for reaction, then merged with a circulated C4 stream from a first-stage reactor outlet buffer tank and fed into a first-stage mixer, wherein it is mixed with hydrogen gas, and fed into the first-stage reactor to undergo a first-stage hydrogenation reaction, and a first-stage reaction stream obtained by the reaction is fed into the first-stage reactor outlet buffer tank;

the hydrogen gas required for the reaction in the first-stage reactor is fed through a first feeding mode or a second feeding mode:

the first feeding mode comprises: all the hydrogen gas required for the reaction is fed through the first-stage reactor outlet buffer tank, and then fed into the first-stage reactor through a first route at an outlet of the first-stage reactor outlet buffer tank;

the second feeding mode comprises: a part of the hydrogen gas required for the reaction is fed through the first-stage reactor outlet buffer tank, and then fed into the first-stage reactor through the first route at an outlet of the first-stage reactor outlet buffer tank; the other part of the hydrogen gas is fed through the first-stage mixer, and then fed into the first-stage reactor;

(3) there is no gas phase discharge from the first-stage reactor outlet buffer tank, the liquid-phase product is divided into at least two streams, wherein the first stream is returned to the first-stage reactor as the circulated C4 stream, and the second stream is used as a feed to a stabilization tower or subjected to further hydrotreatment prior to being fed to the stabilization tower;

(4) a C4 hydrogenation product is recovered after separation in the stabilization tower.

Another aspect of the present invention provides an apparatus for selective hydrogenation of butadiene extraction tail gas, which is used for carrying out the method for selective hydrogenation of butadiene extraction tail gas of the present invention, characterized in that the apparatus comprises: a raw material tank, a feed pump, a coalescer, a first-stage mixer, a first-stage reactor, a first-stage reactor outlet buffer tank, a circulated C4 cooler, a stabilization tower and a hydrogen gas feed pipeline;

the raw material tank, the feed pump, the coalescer, the first-stage mixer, the first-stage reactor and the first-stage reactor outlet buffer tank are connected in sequence;

an outlet pipeline of the first-stage reactor outlet buffer tank is divided into at least two routes, wherein the first route is connected with the circulated C4 cooler, the first-stage mixer and the first-stage reactor in sequence, and the second route is connected with the stabilization tower directly or indirectly;

the hydrogen gas feed pipeline is divided into at least a first pipeline and optionally a second pipeline, wherein the first pipeline is connected with the first-stage reactor outlet buffer tank, and the second pipeline is connected with the first-stage mixer;

preferably, the first-stage reactor is a fixed-bed reactor;

preferably, the first route is connected with the circulated C4 cooler via a circulation pump.

The technical solution of the present invention has at least the following beneficial effects:

By adopting the method and apparatus of the present invention, the butadiene extraction tail gas (alkyne-containing tail gas from butadiene extraction unit) can be fully and safely recycled; and by optimizing the hydrogen gas allocation and feeding mode of the selective hydrogenation process, and using the way of dissolving hydrogen gas to allocate and add hydrogen gas, the distribution of hydrogen gas in the selective hydrogenation reaction is effectively improved, the uneven reactor temperature distribution caused by the uneven distribution of hydrogen gas is overcome, and the selectivity of alkenes in the selective hydrogenation reaction of butadiene tail gas is improved;

in addition, by optimizing the dilution way of raw material and using C4 hydrogenation products with low impurity contents of 1,3-butadiene, butene-1 and heavy components to dilute the raw material, the present invention can solve the problem of high alkyne concentration in the raw material tank, solve the problem of high concentration of gas-phase alkyne tail gas in raw material pressurization, liquefaction and recovery, and also reduce the probability of rehydrogenation of 1,3-butadiene and butene-1 caused by back-mixing of the diluent C4 stream, thereby effectively reducing the product loss, improving the product yield, reducing the impact of heavy component impurities on the catalyst, and prolonging the service life of the catalyst;

in addition, the present invention can further remove the water-soluble impurities in the butadiene extraction tail gas raw material by providing a water-washing tower, so as to improve the adaptability of the raw material.

Other features and advantages of the present invention will be described in detail in the following description.

BRIEF DESCRIPTION OF THE DRAWINGS

Exemplary embodiments of the present invention will be described in more detail with reference to the accompanying drawings.

FIG. 1 shows a schematic diagram of the method for selective hydrogenation of butadiene extraction tail gas according to an example of the present invention, wherein:

device signs are described as follows:

11, a raw material tank; 12, a feed pump; 13, a coalescer; 14, a first-stage mixer; 15, a first-stage reactor; 16, a first-stage reactor outlet buffer tank; 17, a circulation pump; 18, a circulated C4 cooler; 19, a diluent C4 cooler; 110, a stabilization tower; 111, a tower top condenser; 112, a reflux tank; 113, a reflux pump; 114, a tail gas condenser; 115, a diluent C4 pump; 116, a hydrogen gas feed pipeline;

stream signs are described as follows:

1101, an alkyne-containing tail gas (butadiene tail gas) from butadiene extraction unit; 1102, a diluent C4 stream; 1107, a first-stage reactor raw material; 1108, a first-stage reactor product; 1109, a circulated C4 stream; 1112, a stabilization tower feed; 1115, a stabilization tower reflux; 1116, a non-condensable gas; 1117, heavy components; 1118, a C4 hydrogenation product; 1201, a reaction pressure-compensating hydrogen gas; 1202, a reaction-supplement hydrogen gas.

Figure 2:
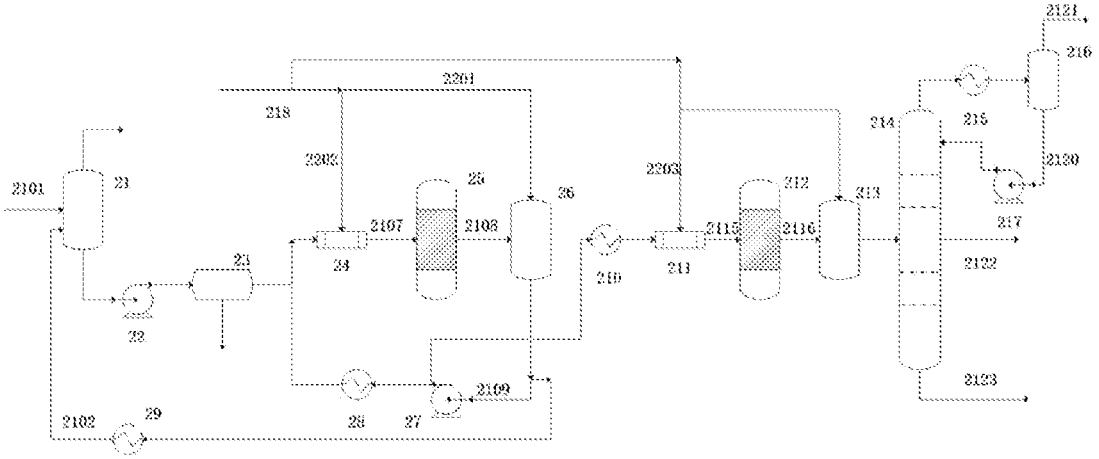

FIG. 2 shows a schematic diagram of the method for selective hydrogenation of butadiene extraction tail gas according to an example of the present invention, wherein:

device signs are described as follows:

21, a raw material tank; 22, a feed pump; 23, a coalescer; 24, a first-stage mixer; 25, a first-stage reactor; 26, a first-stage reactor outlet buffer tank; 27, a circulation pump; 28, a circulated C4 cooler; 29, a diluent C4 cooler; 210, a second-stage feed cooler; 211, a second-stage mixer; 212, a second-stage reactor; 213, a second-stage reactor outlet buffer tank; 214, a stabilization tower; 215, a tower top condenser; 216, a reflux tank; 217, a reflux pump; 218, a hydrogen gas feed pipeline;

stream signs are described as follows:

2101, an alkyne-containing tail gas (butadiene tail gas) from butadiene extraction unit; 2102, a diluent C4 stream; 2107, a first-stage reactor raw material; 2108, a first-stage reactor product; 2109, a circulated C4 stream; 2115, a second-stage reactor raw material; 2116, a second-stage reactor product; 2120, a stabilization tower reflux; 2121, a non-condensable gas; 2122, a C4 alkene product; 2123, heavy components; 2201, a reaction pressure-compensating hydrogen gas; 2202, a first-stage reaction mixed hydrogen gas; 2203, a second-stage reaction mixed hydrogen gas.

Figure 3:
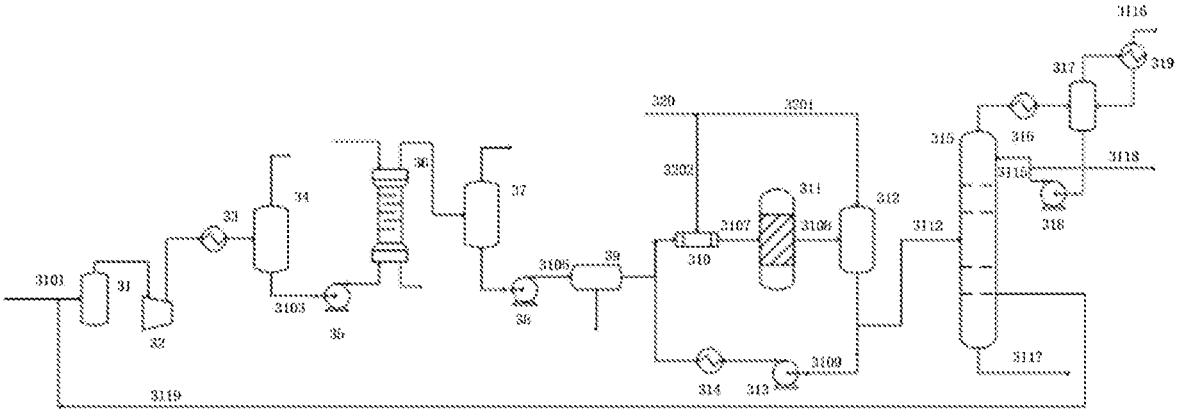

FIG. 3 shows a schematic diagram of the method for selective hydrogenation of butadiene extraction tail gas according to an example of the present invention, wherein:

device signs are described as follows:

31, a blower suction tank; 32, a blower; 33, a liquefaction condenser; 34, a C4 collection tank; 35, a booster pump; 36, a water-washing tower; 37, a raw material tank; 38, a feed pump; 39, a coalescer; 310, a first stage mixer; 311, a first stage reactor; 312, a first-stage reactor outlet buffer tank; 313, a circulation pump; 314, a circulated cooler; 315, a stabilization tower; 316, a tower top condenser; 317, a reflux tank; 318, a reflux pump; 319, a tail gas condenser; 320, a hydrogen gas feed pipeline;

stream signs are described as follows:

3101, an alkyne-containing tail gas (butadiene tail gas) from butadiene extraction unit; 3103, a liquefied C4 raw material; 3105, a C4 feed; 3107, a first-stage reactor raw material; 3108, a first-stage reactor product; 3109, a circulated C4 stream; 3112, a stabilization tower feed; 3115, a stabilization tower reflux; 3116, a non-condensable gas; 3117, heavy components; 3118, a C4 hydrogenation product; 3119, a diluent C4 stream; 3201, a reaction pressure-compensating hydrogen gas; 3202, a reaction mixed hydrogen gas.

SPECIFIC MODELS FOR CARRYING OUT THE PRESENT INVENTION

The present invention will be specifically described below in conjunction with specific examples. It is necessary to point out that the following examples are only used to further illustrate the present invention, and cannot be interpreted as limiting the protection scope of the present invention. Some non-essential improvements and adjustments made by a person skilled in the art according to the present invention still belong to the protection scope of the present invention. In addition, it is noted that various specific technical features described in the following specific embodiments may be combined in any suitable manner if there is no contradiction. In order to avoid unnecessary repetition, various possible combinations are not further described in the present invention.

An aspect of the present invention is to provide a method for selective hydrogenation of butadiene extraction tail gas, characterized in that, the selective hydrogenation method comprises:

(1) an alkyne-containing tail gas from a butadiene extraction unit is fed into a raw material tank, optionally impurities entrained in the alkyne-containing tail gas are removed before being fed into the raw material tank;

(2) a C4 raw material in the raw material tank is pressurized by a feed pump to a pressure required for reaction, then merged with a circulated C4 stream from a first-stage reactor outlet buffer tank and fed into a first-stage mixer, wherein it is mixed with hydrogen gas, and fed into the first-stage reactor to undergo a first-stage hydrogenation reaction, and a first-stage reaction stream obtained by the reaction is fed into the first-stage reactor outlet buffer tank;

the hydrogen gas required for the reaction in the first-stage reactor is fed through a first feeding mode or a second feeding mode:

the first feeding mode comprises: all the hydrogen gas required for the reaction is fed through the first-stage reactor outlet buffer tank, and then fed into the first-stage reactor through a first route at an outlet of the first-stage reactor outlet buffer tank;

the second feeding mode comprises: a part of the hydrogen gas required for the reaction is fed through the first-stage reactor outlet buffer tank, and then fed into the first-stage reactor through the first route at an outlet of the first-stage reactor outlet buffer tank; the other part of the hydrogen gas is fed through the first-stage mixer, and then fed into the first-stage reactor;

(3) there is no gas phase discharge from the first-stage reactor outlet buffer tank, the liquid-phase product is divided into at least two streams, wherein the first stream is returned to the first-stage reactor as the circulated C4 stream, and the second stream is used as a feed to a stabilization tower or subjected to further hydrotreatment prior to being fed into the stabilization tower;

(4) a C4 hydrogenation product is recovered after separation in the stabilization tower.

In the present invention, "alkyne-containing tail gas from butadiene extraction unit" refers to a tail gas rich in alkynes and dienes produced by the butadiene extraction unit when recovering 1,3-butadiene from a cracked C4 fraction of an ethylene unit. The alkyne-containing tail gas from butadiene extraction unit can be used interchangeably with a butadiene extraction tail gas. The concentration of vinyl acetylene (VA) and ethyl acetylene (EA) in the tail gas is relatively high, wherein the content of VA is usually 20%, up to 40 wt %. Due to the different technologies adopted by the butadiene extraction unit, the generated alkyne-containing tail gas comprises two states, liquid phase and gas phase.

Step (1)

In an embodiment, the alkyne-containing tail gas from butadiene extraction unit may be directly fed into the raw material tank.

Alkynes such as vinyl acetylene in the alkyne-containing tail gas have the characteristics of self-decomposition and explosion, which will pose a safety risk. Therefore, it is generally necessary to dilute the tail gas to reduce its concentration and prevent explosion. According to the present invention, materials containing low contents of 1,3-butadiene, butene-1 and heavy components that tend to affect the activity and service life of the catalyst may be used as diluents.

In an embodiment, the alkyne-containing tail gas may be diluted with a side-draw diluent C4 stream from the stabilization column. Preferably, the mass flow ratio of the diluent C4 stream to the alkyne-containing tail gas is 1-30:1, for example 1-20:1, for example 1-10:1. In the present invention, the side-draw diluent C4 stream from the stabilization tower mainly comprises low contents of 1,3-butadiene, butene-1 and heavy components that tend to affect activity and service life of the catalyst.

In an embodiment, the alkyne-containing tail gas may also be diluted with a diluent C4 stream from the first-stage reactor outlet buffer tank. Preferably, the mass flow ratio of the diluent C4 stream to the alkyne-containing tail gas is 1-5:1, for example, 1-4:1.

The choice of the diluent C4 stream from the stabilization tower or the diluent C4 stream from the first-stage reactor outlet buffer tank mainly depends on the catalyst used in the selective hydrogenation reaction and the content of heavy components contained in the diluent C4 stream.

In the present invention, the alkyne-containing tail gas may also entrain impurities such as acetonitrile (ACN), N-methylpyrrolidone (NMP) and N,N-dimethylformamide (DMF). In order to reduce the impact of these impurities on subsequent processes, the alkyne-containing tail gas may be treated to remove the impurities entrained therein before being fed into the raw material tank. For example, a water-washing tower may be set up to remove water-soluble impurities in the alkyne-containing tail gas, so as to improve the adaptability of raw materials.

In an embodiment, the alkyne-containing tail gas may be fed into a water-washing tower to remove the impurities entrained in the alkyne-containing tail gas, and then fed into the raw material tank.

In an embodiment, when the alkyne-containing tail gas is a gas-phase alkyne-containing tail gas, the gas-phase alkyne-containing tail gas may be pressurized and liquefied into a liquid-phase alkyne-containing tail gas, and then fed into a water-washing tower. For example, the alkyne-containing tail gas is fed into a blower suction tank, pressurized by a blower, condensed and liquefied by a liquefaction condenser, and then fed into a C4 collection tank, followed by pressurization by a booster pump and being fed into a water-washing tower to remove the impurities entrained in the alkyne-containing tail gas.

According to the present invention, in the case that the gas-phase alkyne-containing tail gas undergoes a treatment of impurities removal, the alkyne-containing tail gas in the blower suction tank may be diluted.

In an embodiment, the gas-phase alkyne-containing tail gas in the blower suction tank may be diluted with a side-draw gas-phase C4 hydrogenation product from the stabilization tower. Preferably, the mass flow ratio of the gas-phase C4 hydrogenation product to the gas-phase alkyne-containing tail gas is 1-30:1, such as 1-20:1, such as 1-10:1.

In an embodiment, the gas-phase alkyne-containing tail gas in the blower suction tank may also be diluted with a diluent C4 stream from the first-stage reactor outlet buffer tank. Preferably, the mass flow ratio of the diluent C4 stream to the alkyne-containing tail gas is 1-5:1, for example, 1-4:1.

The choice of the diluent C4 stream from the stabilization tower or the diluent C4 stream from the first-stage reactor outlet buffer tank mainly depends on the catalyst used in the selective hydrogenation reaction and the content of heavy components contained in the diluent C4 stream. According to the present invention, the raw material tank has an operating pressure of 0.5-1.0 MPaG.

According to the present invention, preferably, the blower suction tank has an operating pressure of 0-20 KPa.

According to the present invention, the condensed and liquefied gas in the liquefaction condenser has a temperature of 0-20° C.

According to the present invention, the liquefaction condenser has a pressure of 50-100 Kpa.

According to the present invention, the water-washing tower has an operating pressure of 0.5-1.0 MPaG.

According to the present invention, the mass ratio of the washing water to the C4 raw material is 1-5:1 in the water-washing tower.

Step (2)

After the C4 raw material in the raw material tank is pressurized by the feed pump to the required pressure for the reaction, it merges with the circulated C4 stream from the first-stage reactor outlet buffer tank and enters the first-stage mixer. After being mixed with hydrogen gas in the first-stage mixer, it enters the first-stage reactor to perform the first-stage hydrogenation reaction, and the first-stage reaction stream obtained by the reaction enters the first-stage reactor outlet buffer tank. Preferably, the C4 raw material in the raw material tank is a diluted C4 raw material.

According to the present invention, the hydrogen gas required for the first-stage reactor reaction is allocated and fed through a first feeding mode or a second feeding mode.

In the first feeding mode, all the hydrogen gas required for the reaction is fed into the first-stage reactor through the first-stage reactor outlet buffer tank. In the second feeding mode, a part of the hydrogen gas required for the reaction is fed into the first-stage reactor through the first-stage reactor outlet buffer tank, and the other part of the hydrogen gas required for the reaction is fed into the first-stage reactor through the first-stage mixer.

According to the present invention, in the first feeding mode, the hydrogen gas required by the first-stage hydrogenation reactor controls the pressure of the reaction system through pressure compensation, and all the hydrogen gas enters the liquid-phase C4 stream through the way of dissolution, and then is fed with the circulated C4 stream from the first-stage reactor into the first-stage hydrogenation reactor. In the second feeding mode, a part of the hydrogen gas required for the reaction is fed through the first-stage reactor outlet buffer tank. This part of hydrogen gas controls the pressure of the reaction system through pressure compensation, and at the same time enters into the liquid-phase C4 stream through the way of dissolution, and then is fed with the circulated C4 stream from the first-stage reactor into the first-stage hydrogenation reactor.

In the present invention, by adopting the way of dissolving hydrogen gas to partially or completely replace the way of directly introducing hydrogen gas into an inlet of the reactor in the prior art, even distribution of hydrogen gas during the hydrogenation reaction is ensured, thereby improving the selectivity of the hydrogenation reaction.

In the second feeding mode, the mass ratio of the part of hydrogen gas required for the reaction to the hydrogen gas required for the first-stage hydrogenation reaction is not less than 0.3, preferably not less than 0.5, and the hydrogen gas required for the first-stage hydrogenation reaction is a sum of the part of hydrogen gas required for the reaction and the other part of hydrogen gas.

In the second feeding mode, the sum of the amount of the part of hydrogen gas required for the reaction and the amount of the other part of hydrogen gas is equal to the amount of the all hydrogen gas required for the hydrogenation reaction.

According to the present invention, the C4 raw material in the raw material tank is pressurized to 1.0-4.0 MPaG by the feed pump, and the mass flow ratio of the circulated C4 stream to the C4 raw material is 5-30:1. The inlet temperature of the first-stage reactor is 5-60° C., for example, 20-60° C.; the liquid space velocity is 1-50 $h^{-1}$; the pressure of the first-stage reactor is controlled by a pressure-compensating hydrogen gas of the first-stage reactor outlet buffer tank; and the reaction pressure is 1.0-4.0 MPaG.

Preferably, the first-stage reactor is a fixed-bed reactor. The reactor is filled with a selective hydrogenation catalyst.

According to the present invention, a selective hydrogenation catalyst in the prior art, preferably the selective hydrogenation catalyst disclosed in CN102240547, may be used in the selective hydrogenation reaction. Based on the total weight of the catalyst, the palladium-containing catalyst preferably comprises the following components: 0.015 to 2.00 wt % of palladium, 0.005 to 3.0 wt % of a promoter metal, and a carrier as the balance, wherein the promoter metal is at least one selected from lead, silver, tin, magnesium and calcium, and the carrier is at least one selected from aluminum oxide, titanium oxide and magnesium oxide.

According to the present invention, the selective hydrogenation reaction may also use the selective hydrogenation catalysts disclosed in the prior art, such as CN102886262, CN10886397 and/or CN104707622, preferably the selective hydrogenation catalyst disclosed in CN104707622. Based on the total weight of the catalyst, the palladium-free catalyst preferably comprises the following components: 5-15 wt % of copper, 0.1-3 wt % of iridium, 0.1-3 wt % of phosphorus, 0.5-3.0 wt % of a promoter metal, and a carrier as the balance, wherein the promoter metal is at least one selected from nickel, zirconium, lead and tin, and the carrier is at least one selected from alumina, titania, silica, titania-alumina composite oxide, titania-silica composite oxide and alumina-silica composite oxide.

For the production of 1,3-butadiene, both the palladium-containing catalyst and the palladium-free catalyst may be used. Compared with the palladium-free catalyst, the palladium-containing catalyst has higher selectivity and higher olefin yield. However, since the palladium-containing catalyst contains noble metal, the investment and operating costs of the installation using the palladium-containing catalyst will be higher than those using the palladium-free catalyst. The use of catalysts that do not contain precious metals may effectively reduce investment and operating costs of the installation. Therefore, when choosing a catalyst, the relationship between cost and olefin yield needs to be weighed. For the production of butene-1, the palladium-containing catalyst is chosen due to its much higher selectivity and olefin yield.

Step (3)

There is no gas-phase discharge from the first-stage reactor outlet buffer tank, and a liquid-phase product is divided into at least two streams, wherein the first stream is returned to the first-stage reactor as the circulated C4 stream; the second stream is directly fed into the stabilization tower as a feed, or the second stream is further hydrotreated prior to being fed into the stabilization tower.

In the present invention, it is considered whether the second stream of the first-stage reactor outlet buffer tank needs to be further hydrotreated according to the demand of the product. For example, when a higher content of 1,3-butadiene is required in the product, the second stream may be used as a feed and directly fed into the stabilization column without further hydrogenation. When a higher content of butene-1 but a lower content of 1,3-butadiene is required in the product, the second stream needs to be further hydrotreated before being fed into the stabilization column.

Further hydrotreatment of the second stream before being fed into the stabilization tower comprises: the second stream is used as a feed to the second-stage reactor and fed to the second-stage reactor through the second-stage feed cooler and the second-stage mixer to carry out the second-stage hydrogenation reaction, and then a second-stage reaction stream obtained from the reaction in the second-stage reactor passes through a second-stage reactor outlet buffer tank and enters the stabilization tower.

Similar to the first-stage reactor, the hydrogen gas required for the second-stage reactor reaction is allocated and fed through a third feeding mode or a fourth feeding mode. In the third feeding mode, all the hydrogen gas required for the reaction is fed through the first-stage reactor outlet buffer tank, and then fed into the second-stage reactor through a second route at the outlet of the first-stage reactor outlet buffer tank. In the fourth feeding mode, a part of the hydrogen gas required for the reaction is fed through the first-stage reactor outlet buffer tank, and then fed into the second-stage reactor through the second route at the outlet of the first-stage reactor outlet buffer tank; and the other part of the hydrogen gas is fed through the second-stage mixer, and then fed into the second-stage reactor.

In the third feeding mode, the hydrogen gas required by the second-stage reactor controls the pressure of the first-stage reaction system through pressure compensation, and all the hydrogen gas enters the liquid-phase C4 stream through the way of dissolution, and is fed into the second-stage reactor with the feed to the second-stage reactor. In the fourth feeding mode, the part of the hydrogen gas required for the reaction is fed through the first-stage reactor outlet buffer tank. This part of hydrogen gas controls the pressure of the first-stage reaction system through pressure compensation, and at the same time enters the liquid-phase C4 stream by the way of dissolution, and is fed into the second-stage reactor with the feed to the second-stage reactor.

In the fourth feeding mode, the mass ratio of the part of the hydrogen gas required for the reaction to the hydrogen gas required for the second-stage hydrogenation reaction is not less than 0.3, preferably not less than 0.5, and the hydrogen gas required for the second-stage hydrogenation reaction is a sum of the part of the hydrogen gas required for the reaction and the other part of hydrogen.

In the fourth feeding mode, the sum of the amount of the part of hydrogen gas required for the reaction and the amount of the other part of hydrogen gas is equal to the amount of all the hydrogen gas required for the second-stage reaction.

In an embodiment, in order to produce butene-1, a two-stage hydrogenation process may be used for the alkyne-containing tail gas, wherein the alkynes and dienes in the alkyne-containing tail gas are selectively hydrogenated to produce monoolefins by the way of dissolving hydrogen gas, and then light and heavy components are removed by the stabilization tower to obtain a high-quality C4 product.

The first-stage reactor and the second-stage reactor each independently has an inlet temperature of 20-60° C.; the first-stage reactor has a liquid space velocity of 10-50 $h^{-1}$, and the second-stage reactor has a liquid space velocity of 1-10 $h^{-1}$; the first-stage reactor and the second-stage reactor each independently has a pressure of 1.0-4.0 MPaG, that is controlled by a pressure-compensating hydrogen gas of each reactor outlet buffer tank.

The first-stage reactor and the second-stage reactor are both fixed-bed reactors, and the reactors are filled with selective hydrogenation catalysts. As described above, the palladium-containing catalyst is chosen for the production of butene-1, due to its much higher selectivity and olefin yield.

The first-stage selective hydrogenation reaction and the second-stage selective hydrogenation reaction may use the selective hydrogenation catalysts in the prior art, preferably the selective hydrogenation catalyst disclosed in CN102240547. Based on the total weight of the catalyst, the palladium-containing catalyst preferably comprises the following components: 0.015-2.00 wt % of palladium, 0.005-3.0 wt % of a promoter metal, and a carrier as the balance, wherein the promoter metal is at least one selected from lead, silver, tin, magnesium and calcium, and the carrier is at least one selected from aluminum oxide, titanium oxide and magnesium oxide.

Step (4)

The C4 hydrogenation product is recovered after separation in the stabilization tower, and the C4 hydrogenation product comprises 1,3-butadiene and butene-1.

According to the present invention, when adopting an one-stage hydrogenation process to produce 1,3-butadiene, a condenser, preferably a two-stage condenser, is used at the top of the stabilization tower to recover the C4 components entrained in the non-condensable gas, a liquid phase recovery of the hydrogenation product with high contents of 1,3-butadiene and butene-1 is carried out by a reflux tank at the top of the tower, heavy components are removed from the tower kettle, and the C4 hydrogenation product with low contents of 1,3-butadiene, butene-1 and heavy components that tend to adversely affect catalyst activity and lifetime is obtained as a side-draw. The side-draw product may be used to dilute the C4 tail gas raw material. The phase state of the side-draw product of the stabilization tower is gas phase or liquid phase.

According to the present invention, when adopting a two-stage hydrogenation process to produce butene-1, the C4 product at the outlet of the second-stage reactor (the second-stage reaction stream obtained by the reaction in the second-stage reactor) enters the second-stage reactor outlet buffer tank, and the C4 stream from the bottom of the buffer tank enters the stabilization tower. A non-condensable gas is removed from the top of the stabilization tower, no liquid phase is obtained at the top of the tower, and total reflux is adopted; heavy components are removed from the bottom of the tower; and a high-quality C4 olefin product is obtained as a side-draw.

The stabilization tower has an operating pressure of 0.4-1.2 MPaG, a theoretical plate number of 10-40, and a theoretical plate position for recovering a side-draw at 5-35.

In the present invention, after the liquid-phase butadiene tail gas is diluted and pressurized, a catalyst such as noble metal-free catalyst is used for the selective hydrogenation reaction, and light and heavy components are removed through the stabilization tower to obtain a C4 olefin product with low content of alkyne and enriched 1,3-butadiene, which may be returned to the butadiene extraction unit for further recovery of 1,3-butadiene and monoolefins.

In a specific embodiment, the present invention provides a method for selective hydrogenation of butadiene extraction tail gas, characterized in that, the selective hydrogenation method comprises:

(1) an alkyne-containing tail gas from a butadiene extraction unit is fed into a raw material tank;

(2) the raw material in the raw material tank is pressurized by a feed pump to the pressure required for the reaction, then merged with a circulated C4 stream from a first-stage reactor outlet buffer tank and fed into a first-stage mixer, wherein it is mixed with hydrogen gas and fed into a first-stage reactor to undergo a hydrogenation reaction, and a first-stage reaction stream obtained by the reaction is fed into the first-stage outlet buffer tank;

the hydrogen gas required for the first-stage reactor reaction is fed through a first feeding mode or a second feeding mode:

the first feeding mode comprises: all the hydrogen gas required for the reaction is fed through the first-stage reactor outlet buffer tank, and then fed into the first-stage reactor through a first route at an outlet of the first-stage reactor outlet buffer tank;

the second feeding mode comprises: a part of the hydrogen gas required for the reaction is fed through the first-stage reactor outlet buffer tank, and then fed into the first-stage reactor through the first route at an outlet of the first-stage reactor outlet buffer tank; and the other part of the hydrogen gas is fed through the first-stage mixer, and then fed into the first-stage reactor;

(3) there is no gas-phase discharge from the first-stage reactor outlet buffer tank, and a liquid phase product is divided into two streams, wherein the first stream is returned to the first-stage reactor as the circulated C4 stream, and the second stream is used as a feed to the stabilization tower;

(4) the first-stage reaction stream obtained from the reaction in the first-stage reactor is fed into the stabilization tower through the first-stage reactor outlet buffer tank, and separated through the stabilization tower to recover a C4 hydrogenation product.

In a preferred embodiment, in step (1), the alkyne-containing tail gas is diluted with a side-draw diluent C4 stream from the stabilization tower, preferably, the mass flow ratio of the diluent C4 stream and the alkyne-containing tail gas is 1 to 30:1.

In a preferred embodiment, in step (2), in the second feeding mode, the mass ratio of the part of the hydrogen gas required for the reaction to the hydrogen gas required for the hydrogenation reaction is not less than 0.3, preferably not less than 0.5, and the hydrogen gas required for the hydrogenation reaction is a sum of the part of the hydrogen gas required for the reaction and the other part of the hydrogen gas.

In a preferred embodiment, in step (1), the raw material tank has an operating pressure of 0.5-1.0 MPaG;

in step (2), the diluted C4 raw material is pressurized by the feed pump to 1.0-4.0 MPaG, the mass flow ratio of the circulated C4 stream to the diluted C4 raw material is 5-30:1, the first-stage reactor has an inlet temperature of 5-60° C., and a liquid space velocity of 1-40 h−1, the pressure of the first-stage reactor is controlled by a pressure-compensating hydrogen gas of the first-stage reactor outlet buffer tank, and the reaction pressure is 1.0-4.0 MPaG;

in step (4), the stabilization tower has an operating pressure of 0.4-1.0 MPaG, a theoretical plate number of 10-40, and a theoretical plate position for recovering a side-draw at 5-35.

In a specific embodiment, the present invention provides a method for selective hydrogenation of butadiene extraction tail gas, characterized in that, the selective hydrogenation method comprises:

(1) an alkyne-containing tail gas from a butadiene extraction unit is fed into a raw material tank, and the alkyne-containing tail gas in the raw material tank is diluted with a diluent C4 stream from a first-stage reactor outlet buffer tank;

(2) the diluted raw material in the raw material tank is pressurized by a feed pump to a pressure required for the reaction, then mixed with a circulated C4 stream from the first-stage reactor outlet buffer tank and fed into a first-stage mixer, wherein it is mixed with hydrogen gas, and then fed into the first-stage reactor to undergo a first-stage hydrogenation reaction, and the first-stage reaction stream obtained by the reaction is fed into the first-stage reactor outlet buffer tank;

the hydrogen gas required for the first-stage reactor reaction is fed through a first feeding mode or a second feeding mode:

the first feeding mode comprises: all the hydrogen gas required for the reaction is fed through the first-stage reactor outlet buffer tank, and then enters the first-stage reactor through a first route at an outlet of the first-stage reactor outlet buffer tank;

the second feeding mode comprises: a part of the hydrogen gas required for the reaction is fed through the first-stage reactor outlet buffer tank, and then enters the first-stage reactor through the first route at an outlet of the first-stage reactor outlet buffer tank; and the other part of the hydrogen gas is fed through the first-stage mixer, and then enters the first-stage reactor;

(3) there is no gas-phase discharge from the first-stage reactor outlet buffer tank, and a liquid phase product is divided into three streams, wherein the first stream is returned to the first-stage reactor as the circulated C4 stream, the second stream is used as a feed to the second-stage reactor and fed into a second-stage reactor through a second-stage feed cooler and a second-stage mixer to carry out a second-stage hydrogenation reaction; and the third stream is used as a diluent C4 stream and fed into the raw material tank;

the hydrogen gas required for reaction in the second-stage reactor is fed through a third feeding mode or a fourth feeding mode:

the third feeding mode comprises: all the hydrogen gas required for the reaction is fed through the first-stage reactor outlet buffer tank, and then enters the second-stage reactor through a second route at an outlet of the first-stage reactor outlet buffer tank;

the fourth feeding mode comprises: a part of the hydrogen gas required for the reaction is fed through the first-stage reactor outlet buffer tank, and then enters the second-stage reactor through a second route at an outlet of the first-stage reactor outlet buffer tank; and the other part of the hydrogen gas is fed through the second-stage mixer, and then enters the second-stage reactor;

(4) a second-stage reaction stream obtained from the reaction in the second-stage reactor is fed into the stabilization tower through the second-stage reactor outlet buffer tank, and separated through the stabilization tower to recover a C4 olefin product as a side-draw.

In a preferred embodiment, in step (2), in the second feeding mode, the mass ratio of the part of the hydrogen gas required for the reaction to the hydrogen gas required for the first-stage hydrogenation reaction is not less than 0.3, preferably not less than 0.5, and the hydrogen gas required for the hydrogenation reaction is a sum of the part of the hydrogen gas required for the reaction and the other part of the hydrogen gas.

In a preferred embodiment, in step (3), in the fourth feeding mode, the mass ratio of the part of the hydrogen gas required for the reaction to the hydrogen gas required for the second-stage hydrogenation reaction is not less than 0.3, preferably not less than 0.5, and the hydrogen gas required for the second-stage hydrogenation reaction is a sum of the part of the hydrogen gas required for the reaction and the other part of the hydrogen gas.

In a preferred embodiment, in step (1), the raw material tank has an operating pressure of 0.5-1.0 MPaG, and the mass flow ratio of the diluent C4 stream to the alkyne-containing tail gas is 1-5:1;

in step (2), the diluted raw material is pressurized to 1.0-4.0 MPaG by the feed pump, and the mass flow ratio of the circulated C4 stream to the diluted C4 raw material is 5-30:1;

in step (4), the stabilization tower has an operating pressure of 0.6-1.2 MPaG, a theoretical plate number of 10-40, and a theoretical plate position for recovering a side-draw at 5-35;

wherein, the first-stage reactor and the second-stage reactor each independently has an inlet temperature of 20-60° C., the first-stage reactor has a liquid space velocity of 10-50 $h^{-1}$, and the second-stage reactor has a liquid space velocity of 1-10 $h^{-1}$; the first-stage reactor and the second-stage reactor each independently has a pressure of 1.0-4.0 MPaG that is controlled by a pressure-compensating hydrogen gas of each reactor outlet buffer tank.

In a specific embodiment, the present invention provides a method for selective hydrogenation of butadiene extraction tail gas, characterized in that, the selective hydrogenation method comprises:

(1) a gas-phase alkyne-containing tail gas from a butadiene unit is fed into a blower suction tank, and the gas-phase alkyne-containing tail gas is pressurized by a blower, condensed and liquefied by a liquefaction condenser, and then fed into a C4 collection tank, followed by pressurization by a booster pump and being fed into a water-washing tower to remove impurities entrained in the alkyne-containing tail gas and then fed into a raw material tank;

(2) the C4 raw material in the raw material tank is pressurized by a feed pump to a pressure required for the reaction, then merged with a circulated C4 stream from a first-stage reactor outlet buffer tank and fed into a first-stage mixer, wherein it is mixed with hydrogen gas, and fed into a first-stage reactor to undergo a hydrogenation reaction, and the first-stage reaction stream obtained by the reaction is fed into the first-stage reactor outlet buffer tank;

the hydrogen gas required for reaction in the first-stage reactor is fed through a first feeding mode or a second feeding mode:

the first feeding mode comprises: all the hydrogen gas required for the reaction is fed through the first-stage reactor outlet buffer tank, and then enters the first-stage reactor through a first route at an outlet of the first-stage reactor outlet buffer tank;

the second feeding mode comprises: a part of the hydrogen gas required for the reaction is fed through the first-stage reactor outlet buffer tank, and then enters the first-stage reactor through the first route at an outlet of the first-stage reactor outlet buffer tank; and the other part of the hydrogen gas is fed through the first-stage mixer, and then enters the first-stage reactor;

(3) there is no gas-phase discharge from the first-stage reactor outlet buffer tank, and a liquid phase product is divided into two streams, wherein the first stream is returned to the first-stage reactor as the circulated C4 stream, and the second stream is used as a feed to the stabilization tower;

(4) the first-stage reaction stream obtained from the reaction in the first-stage reactor is fed into the stabilization tower through the first-stage reactor outlet buffer tank, and separated through the stabilization tower to recover a C4 hydrogenation product.

In a preferred embodiment, in step (1), the gas-phase alkyne-containing tail gas in the blower suction tank is diluted with a side-draw gas-phase C4 hydrogenation product from the stabilization tower; preferably, the mass flow ratio of the gas-phase C4 hydrogenation product to the gas-phase alkyne-containing tail gas is 1-30:1.

In a preferred embodiment, in step (2), in the second feeding mode, the mass ratio of the part of the hydrogen gas required for the reaction to the hydrogen gas required for the hydrogenation reaction is not less than 0.3, preferably not less than 0.5, and the hydrogen gas required for the hydrogenation reaction is a sum of the part of the hydrogen gas required for the reaction and the other part of the hydrogen gas.

In a preferred embodiment, in step (1), the blower suction tank has an operating pressure of 0-20 KPa; the condensed and liquefied gas in the liquefaction condenser has a temperature of 0-20° C., and the liquefaction condenser has a pressure of 50-100 KPa; the water-washing tower has an operating pressure of 0.5-1.0 MPaG, the mass ratio of the washing water in the water-washing tower to the C4 raw material is 1-5:1; and the raw material tank has an operating pressure of 0.5-1.0 MpaG;

in step (2), the C4 raw material is pressurized to 1.0-4.0 MPaG by the feed pump;

the first-stage reactor has an inlet temperature of 5-60° C., a liquid space velocity of 10-50 $h^{-1}$; the first-stage reactor has a reaction pressure of 1.0-4.0 MPaG that is controlled by a pressure-compensating hydrogen gas of the first-stage reactor outlet buffer tank;

in step (4), the stabilization tower has an operating pressure of 0.4-1.0 MPaG, a theoretical plate number of 10-40, and a theoretical plate position for recovering a side-draw at 5-35.

Another aspect of the present invention provides an apparatus for selective hydrogenation of butadiene extraction tail gas, which is used for carrying out the method for selective hydrogenation of butadiene extraction tail gas of the present invention, characterized in that the apparatus comprises: a raw material tank, a feed pump, a coalescer, a first-stage mixer, a first-stage reactor, a first-stage reactor outlet buffer tank, a circulated C4 cooler, a stabilization tower and a hydrogen gas feed pipeline;

the raw material tank, the feed pump, the coalescer, the first-stage mixer, the first-stage reactor and the first-stage reactor outlet buffer tank are connected in sequence;

an outlet pipeline of the first-stage reactor outlet buffer tank is divided into at least two routes, wherein the first route is connected with the circulated C4 cooler, the first-stage mixer and the first-stage reactor in sequence, and the second route is directly or indirectly connected with the stabilization tower;

the hydrogen gas feed pipeline is divided into at least a first pipeline and optionally a second pipeline, wherein the first pipeline is connected with the first-stage reactor outlet buffer tank, and the second pipeline is connected with the first-stage mixer;

preferably, the first-stage reactor is a fixed-bed reactor;

preferably, the first route is connected with the circulated C4 cooler via a circulation pump.

In the present invention, the raw material tank is provided with a butadiene extraction tail gas feed port and a diluent C4 port.

In an embodiment, the diluent C4 port of the raw material tank may be connected with an outlet of the stabilization tower, preferably an outlet of the stabilization tower is connected with the diluent C4 port through a diluent C4 pump and/or a diluent C4 cooler.

In an embodiment, the diluent C4 port of the raw material tank may be connected with an outlet pipeline of the first-stage reactor outlet buffer tank, preferably, a diluent C4 cooler is further provided between the diluent C4 port of the raw material tank and the outlet pipeline of the first-stage reactor outlet buffer tank.

In an embodiment, a top outlet of the stabilization tower is sequentially connected with a tower top condenser, a reflux tank and a reflux pump, and an outlet of the reflux pump is connected with an inlet of the stabilization tower.

In an embodiment, a top outlet of the stabilization tower is sequentially connected with a tower top condenser, a reflux tank and a reflux pump, an outlet of the reflux tank is connected with a tail gas condenser, an outlet of the tail gas condenser is connected with an inlet of the reflux tank, and another outlet of the reflux tank is connected with an inlet of the stabilization tower through the reflux pump.

According to the present invention, the apparatus for selective hydrogenation of butadiene extraction tail gas may further comprise a blower suction tank, a blower, a liquefaction condenser, a C4 collection tank, a booster pump and a water-washing tower, which are connected in sequence, and a C4 raw material outlet of the water-washing tower is connected with the raw material tank.

In an embodiment, an outlet of the stabilization tower is connected with a diluent C4 port of the blower suction tank.

In an embodiment, the water-washing tower is provided at top with a washing water inlet and a C4 raw material outlet, and provided at bottom with a liquefied C4 raw material inlet and a washing water outlet, and the booster pump is connected with the liquefied C4 raw material inlet.

According to the present invention, the apparatus for selective hydrogenation of butadiene extraction tail gas may further comprises a second-stage feed cooler, a second-stage mixer, a second-stage reactor and a second-stage reactor outlet buffer tank, which are connected in sequence, and the second route of the outlet pipeline of the first-stage reactor outlet buffer tank is connected with the second-stage feed cooler, and the second-stage reactor outlet buffer tank is connected with the stabilization tower; preferably, the second route is connected with the second-stage feed cooler through a circulation pump; preferably, the second-stage reactor is a fixed-bed reactor.

In an embodiment, the hydrogen gas feed pipeline is divided into at least a first pipeline and optionally a second pipeline and a third pipeline, wherein the first pipeline is connected with the first-stage reactor outlet buffer tank, the second pipeline is connected with the first-stage mixer, and the third pipeline is connected with the second-stage mixer; preferably, the hydrogen gas feed pipeline may further comprise a pressure-compensating pipeline that is connected with the second-stage reactor outlet buffer tank.

In an embodiment, an outlet pipeline of the first-stage reactor outlet buffer tank is divided into two routes, wherein the first route is connected with the circulated C4 cooler, the first-stage mixer and the first-stage reactor in sequence, and the second route is directly connected with the stabilization tower.

In an embodiment, an outlet pipeline of the first-stage reactor outlet buffer tank is divided into three routes, wherein the first route is connected with the circulated C4 cooler, the first-stage mixer and the first-stage reactor in sequence, the second route is connected with the second-stage feed cooler, and the third route is connected with the diluent C4 port of the raw material tank; and the hydrogen gas feed pipeline is divided into at least a first pipeline and optionally a second pipeline and a third pipeline, wherein the first pipeline is connected with the first-stage reactor outlet buffer tank, the second pipeline is connected with the first-stage mixer, and the third pipeline is connected with the second-stage mixer.

In a specific embodiment, the present invention provides an apparatus for selective hydrogenation of butadiene extraction tail gas, which is used for carrying out the method for selective hydrogenation of butadiene extraction tail gas of the present invention, characterized in that the apparatus comprises: a raw material tank, a feed pump, a coalescer, a first-stage mixer, a first-stage reactor, a first-stage reactor outlet buffer tank, a circulated C4 cooler, a stabilization tower and a hydrogen gas feed pipeline;

the raw material tank, the feed pump, the coalescer, the first-stage mixer, the first-stage reactor and the first-stage reactor outlet buffer tank are connected in sequence;

an outlet pipeline of the first-stage reactor outlet buffer tank is divided into two routes, wherein the first route is connected with the circulated C4 cooler, the first-stage mixer and the first-stage reactor in sequence; and the second route is connected with the stabilization tower;

the hydrogen gas feed pipeline is divided into at least a first pipeline and optionally a second pipeline, wherein the first pipeline is connected with the first-stage reactor outlet buffer tank, and the second pipeline is connected with the first-stage mixer.

In a preferred embodiment, an outlet of the stabilization tower is connected with the diluent C4 port of the raw material tank.

In a preferred embodiment, an outlet of the stabilization tower, the diluent C4 pump, the diluent C4 cooler and the diluent C4 port of the raw material tank are connected in sequence.

In a preferred embodiment, the first route of the outlet pipeline of the reactor outlet buffer tank is connected with the circulated C4 cooler via a circulation pump.

In a specific embodiment, the present invention provides an apparatus for selective hydrogenation of butadiene extraction tail gas, which is used for carrying out the method for selective hydrogenation of butadiene extraction tail gas of the present invention, characterized in that the apparatus comprises: a raw material tank, a feed pump, a coalescer, a first-stage mixer, a first-stage reactor, a first-stage reactor outlet buffer tank, a circulated C4 cooler, a second-stage feed cooler, a second-stage mixer, a second-stage reactor, a second-stage reactor outlet buffer tank, a stabilization tower and a hydrogen gas feed pipeline;

the raw material tank, the feed pump, the coalescer, the first-stage mixer, the first-stage reactor and the first-stage reactor outlet buffer tank are connected in sequence;

the second-stage feed cooler, the second-stage mixer, the second-stage reactor, the second-stage reactor outlet buffer tank and the stabilization tower are connected in sequence;

the raw material tank is provided with a butadiene extraction tail gas inlet and a diluent C4 port;

an outlet pipeline of the first-stage reactor outlet buffer tank is divided into three routes, wherein the first route is connected with the circulated C4 cooler, the first-stage mixer and the first-stage reactor in sequence, the second route is connected with the second-stage feed cooler, and the third route is connected with the diluent C4 port of the raw material tank;

the hydrogen gas feed pipeline is divided into at least a first pipeline and optionally a second pipeline and a third pipeline, wherein the first pipeline is connected with the first-stage reactor outlet buffer tank, the second pipeline is connected with the first-stage mixer, and the third pipeline is connected with the second-stage mixer.

In a preferred embodiment, the first route of the outlet pipeline of the first-stage reactor outlet buffer tank is connected with the circulated C4 cooler through a circulation pump; and the second route of the outlet pipeline of the first-stage reactor outlet buffer tank is connected with the second-stage feed cooler through a circulation pump.

In a preferred embodiment, a diluent C4 cooler is further provided between an outlet of the first-stage reactor outlet buffer tank and the diluent C4 port of the raw material tank.

In a preferred embodiment, the hydrogen gas feed pipeline further comprises a pressure-compensating pipeline that is connected with the second-stage reactor outlet buffer tank.

In a specific embodiment, the present invention provides an apparatus for selective hydrogenation of butadiene extraction tail gas, which is used for carrying out the method for selective hydrogenation of butadiene extraction tail gas of the present invention, characterized in that the apparatus comprises: a blower suction tank, a blower, a liquefaction condenser, a C4 collection tank, a booster pump, a water-washing tower, a raw material tank, a feed pump, a coalescer, a first-stage mixer, a first-stage reactor, a first-stage reactor outlet buffer tank, a circulated cooler, a stabilization tower and a hydrogen gas feed pipeline;

the blower suction tank, the blower, the liquefaction condenser, the C4 collection tank, the booster pump and the water-washing tower are connected in sequence;

an C4 raw material outlet of the water-washing tower, the raw material tank, the feed pump, the coalescer, the first-stage mixer, the first-stage reactor, and the first-stage reactor outlet buffer tank are connected in sequence;

an outlet pipeline of the first-stage reactor outlet buffer tank is divided into two routes, wherein the first route is connected with the circulated cooler, the first-stage mixer and the first-stage reactor in sequence; and the second route is connected with the stabilization tower;

the hydrogen gas feed pipeline is divided into at least a first pipeline and optionally a second pipeline, wherein the first pipeline is connected with the first-stage reactor outlet buffer tank, and the second pipeline is connected with the first-stage mixer.

In a preferred embodiment, an outlet of the stabilization tower is connected with a diluent C4 port of the blower suction tank.

In a preferred embodiment, the water-washing tower is provided at top with a washing water inlet and a C4 raw material outlet, and provided at bottom with a liquefied C4 raw material inlet and a washing water outlet, and the booster pump is connected with the liquefied C4 raw material inlet.

In a preferred embodiment, the first route of the outlet pipeline of the first-stage reactor outlet buffer tank is connected with the circulated cooler through a circulation pump.

EXAMPLE

The present invention is further illustrated by the following examples.

Example 1

Figure 1:
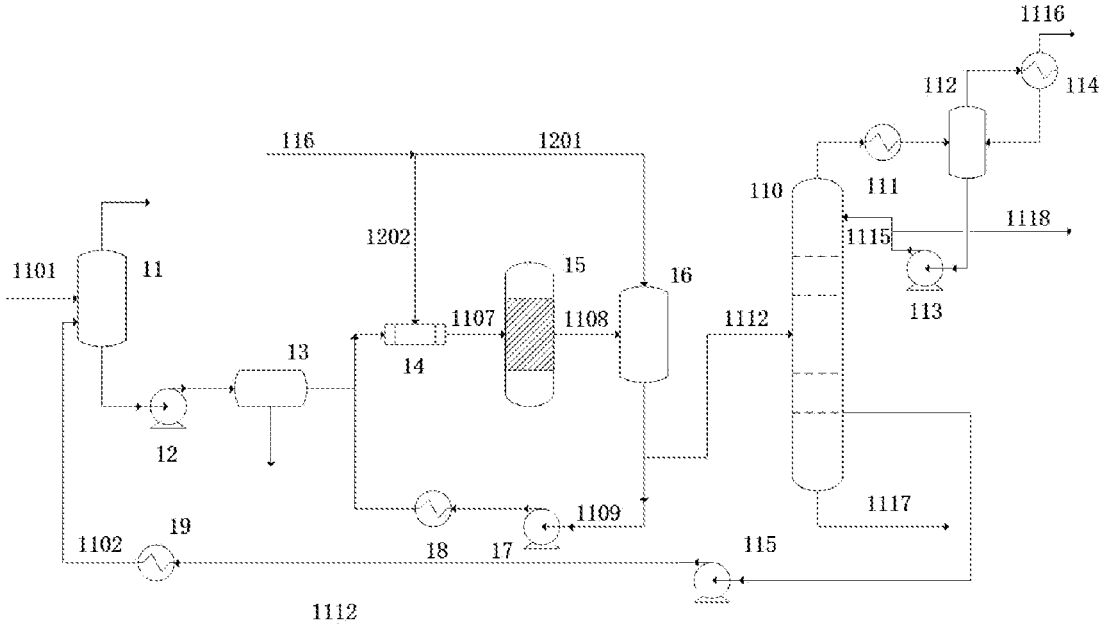

As shown in FIG. 1, this example provided an apparatus for selective hydrogenation of butadiene extraction tail gas, and the apparatus comprised: a raw material tank 11, a feed pump 12, a coalescer 13, a first-stage mixer 14, a first-stage reactor 15, a first-stage reactor outlet buffer tank 16, a circulation pump 17, a circulated C4 cooler 18, a diluent C4 cooler 19, a stabilization tower 110, a tower top condenser 111, a reflux tank 112, a reflux pump 113, a tail gas condenser 114, a diluent C4 pump 115 and a hydrogen gas feed pipeline 116;

wherein, the raw material tank 11 was provided with a butadiene extraction tail gas inlet and a diluent C4 port, and the bottom of the raw material tank 11, the feed pump 12, the coalescer 13, the first-stage mixer 14, the first-stage reactor 15 and the first-stage reactor outlet buffer tank 16 were connected in sequence;

an outlet pipeline of the first-stage reactor outlet buffer tank 16 was divided into two routes, wherein the first route was connected with the circulated C4 cooler 18, the first-stage mixer 14 and the first-stage reactor 15 in sequence; the second route was connected with the stabilization tower 110; wherein, the first route of the outlet pipeline of the first-stage reactor outlet buffer tank 16 was connected with the circulated C4 cooler 18 through the circulation pump 17;

the hydrogen gas feed pipeline 116 was divided into at least a first pipeline and optionally a second pipeline, wherein the first pipeline was connected with a top inlet of the first-stage reactor outlet buffer tank 16, and the second pipeline was connected with the first-stage mixer 14;

wherein, an outlet of the stabilization tower 110, the diluent C4 pump 115, the diluent C4 cooler 19 and the diluent C4 port of the raw material tank 11 were connected in sequence; a top outlet of the stabilization tower 110 was connected with the tower top condenser 111 and the reflux tank 112 in sequence; an outlet of the reflux tank 112 was connected with the tail gas condenser 114, and an outlet of the tail gas condenser 114 was connected with an inlet of the reflux tank 112; another outlet of the reflux tank 112 was connected with the reflux pump 113, and an outlet of the reflux pump 113 was connected with an inlet of the stabilization tower 110;

wherein, the hydrogenation reactor 15 was a fixed-bed reactor.

The apparatus for selective hydrogenation of butadiene extraction tail gas of this example was used to carry out a method for selective hydrogenation of butadiene extraction tail gas, and the selective hydrogenation method comprised:

(1) An alkyne-containing tail gas 1101 from a butadiene extraction unit (based on the total weight of the alkyne-containing tail gas, the main components of the alkyne-containing tail gas were: 58.69% butene, 10.35% butadiene, 17.65% ethyl acetylene and 4.00% vinyl acetylene, 2.05% C5 and higher, 0.02% water) was fed into the raw material tank 11, and the alkyne-containing tail gas in the raw material tank was diluted with the cooled diluent C4 1102 that was from a side-draw of the stabilization tower 110; wherein, the alkyne-containing tail gas 1101 had a flow rate of 1825 kg/h, and a pressure of 0.8 MPaG; the diluent C4 1102 had a flow rate of 5000 kg/h, after dilution, in the raw material tank 11, the liquid-phase vinyl acetylene content was 5.32%, and the vinyl acetylene content in the gas phase was 4.75%.

(2) The diluted raw material in the raw material tank 11 was pressurized to 2.7 MPaG by the feed pump, then merged with the circulated C4 stream 1109 from the first-stage reactor outlet buffer tank 16 and fed into the first-stage mixer 14, wherein it was mixed with hydrogen gas (i.e., to obtain hydrogenation reactor raw material 1107), and fed into the first-stage reactor 15 for hydrogenation reaction, and the first-stage reaction stream (hydrogenation reactor product 1108) obtained by the reaction was fed into the first-stage reactor outlet buffer tank 16; the circulated C4 stream 1109 has a flow rate of 45000 kg/h, the mixed C4 feed had a flow rate of 46825 kg/h, and a temperature of 20° C.

The hydrogen gas required for the reaction in the first-stage reactor 15 was allocated and fed through a first feeding mode;

The first feeding mode comprised: all the hydrogen gas required for the reaction was fed through the first-stage reactor outlet buffer tank 16, and then fed into the first-stage reactor 15 through a first route at the outlet of the first-stage reactor outlet buffer tank 16; wherein, the pressure of the reaction system was controlled by the hydrogen gas required for the reaction in the first-stage reactor 15 through pressure-compensation and the pressure was 2.3 MPaG; the hydrogen gas was fed into the liquid-phase C4 stream through a way of dissolution and then was fed with the circulated C4 stream 1109 of the reactor into the hydrogenation reactor, the circulated C4 stream 1109 had a flow rate of 45000 kg/h, the hydrogen gas dissolved therein had a flow rate of 34.0 kg/h, hydrogen gas was no longer fed into the first-stage mixer 14 provided at the inlet of the first-stage reactor 15, and the reaction liquid phase had a total space velocity of 15 $h^{-1}$; the first-stage reactor 15 had an inlet temperature of 20° C.;

(3) The first-stage reactor outlet buffer tank 16 had no gas-phase discharge, and the liquid phase product was divided into two streams, wherein the first stream was returned to the hydrogenation reactor as the circulated C4 stream 1109, and the second stream was used as the stabilization tower feed 1112; the stabilization tower feed 1112 had a flow rate of 6853 kg/h;

(4) The first-stage reaction stream (the first-stage reactor product 1108) obtained from the reaction in the first-stage reactor 15 was fed into the stabilization tower 110 through the first-stage reactor outlet buffer tank 16, and separated by the stabilization tower 110 to produce a C4 hydrogenation product 1118; wherein, the stabilization tower 110 was used to remove non-condensable gas 1116 from the tower top, to remove heavy components 1117 from the tower kettle, to produce a liquid-phase C4 hydrogenation product 1118 rich in 1,3-butadiene and monoolefins from the tower top, and to recover as a side-draw the diluent C4 stream 1102 that is used for diluting raw materials and at a flow rate of 5000 kg/h. The stabilization tower 110 had a theoretical plate number of 30, an operating pressure of 0.5 MPaG, a tower top temperature of 56.7° C., a tower kettle temperature of 100.2° C., a reflux (stabilization tower reflux 1115) flow rate of 5600 kg/h, and a theoretical plate position for recovering a side-draw at 25.

The results of main streams were shown in Table 1.

The catalyst used in Examples 1 and 2 was: based on the total weight of the catalyst, the catalyst was composed of the following components: copper at a content of 7 wt %, iridium at a content of phosphorus at a content of 2 wt %, nickel at a content of 3 wt %, and a carrier as the balance, in which the carrier was a titania-alumina composite oxide.

TABLE 1

| Stream No. | 1101 | 1102 | 1108 | 1118 | 1201 | 1202 |
|---|---|---|---|---|---|---|
| Phase state | Liquid | Liquid | Liquid | Liquid | Gas | Gas |
| Temperature [° C.] | 40.0 | 20.1 | 35.3 | 15.0 | 15.8 | 15.8 |
| Pressure [MPa(g)] | 0.80 | 0.65 | 2.30 | 0.50 | 2.40 | 2.40 |
| Molar composition | % | % | % | % | % | % |
| Hydrogen gas | 0.00 | 0.00 | 0.00 | 0.17 | 95.00 | 95.00 |
| Methane | 0.00 | 0.00 | 0.46 | 0.60 | 5.00 | 5.00 |
| Propane | 0.00 | 0.00 | 0.00 | 0.00 | 0.00 | 0.00 |
| Propylene | 0.01 | 0.00 | 0.00 | 0.01 | 0.00 | 0.00 |
| Propyne | 0.00 | 0.00 | 0.00 | 0.00 | 0.00 | 0.00 |
| n-Butane | 2.57 | 4.14 | 3.91 | 3.40 | 0.00 | 0.00 |
| iso-Butane | 4.67 | 0.84 | 1.87 | 4.75 | 0.00 | 0.00 |
| Butene-1 | 14.20 | 11.32 | 14.57 | 23.10 | 0.00 | 0.00 |
| iso-Butylene | 22.05 | 9.32 | 12.72 | 22.57 | 0.00 | 0.00 |
| cis-2-butene | 18.79 | 44.13 | 37.31 | 19.70 | 0.00 | 0.00 |
| trans-2-butene | 3.65 | 11.48 | 10.47 | 8.06 | 0.00 | 0.00 |
| 1,3-Butadiene | 6.35 | 9.30 | 10.78 | 16.29 | 0.00 | 0.00 |
| 1,2-Butadiene | 4.00 | 5.06 | 3.93 | 0.91 | 0.00 | 0.00 |
| Ethyl acetylene | 4.00 | 0.31 | 0.26 | 0.12 | 0.00 | 0.00 |
| Vinyl acetylene | 17.63 | 0.76 | 0.64 | 0.31 | 0.00 | 0.00 |
| n-Pentane | 1.80 | 3.21 | 2.82 | 0.00 | 0.00 | 0.00 |
| C5+ | 0.25 | 0.06 | 0.27 | 0.00 | 0.00 | 0.00 |
| Water | 0.02 | 0.00 | 0.00 | 0.00 | 0.00 | 0.00 |
| Molar flow rate [kmol/h] | 32.78 | 88.56 | 1186.79 | 31.02 | 12.51 | 0.00 |
| Mass flow rate [kg/h] | 1825.00 | 5000.00 | 66825 | 1724.50 | 34.00 | 0.00 |

It can be seen from Table 1 that, in the product, the content of 1,3-butadiene was about 10% higher than that in the raw material, the content of alkynes was less than 0.5%, and the total conversion rate of alkynes was greater than 97%, which could meet the raw material requirements of the butadiene extraction unit.

Example 2

As shown in FIG. 1, compared with Example 1, this example had the following differences:

In step (2), the hydrogen gas required for the reaction in the first-stage reactor 15 was allocated and fed through a second feeding mode; the second feeding mode comprised: a part of the hydrogen gas required for the reaction was fed through the first-stage reactor outlet buffer tank 16, and then fed into the first-stage reactor 15 through a first route of an outlet of the first-stage reactor outlet buffer tank 16; the other part of hydrogen gas was fed through the first-stage mixer 14, and then entered the first-stage reactor 15; wherein most of the hydrogen gas was fed through the first-stage reactor outlet buffer tank 16, and this part of the hydrogen gas controlled the pressure of the reaction system through pressure compensation, and at the same time entered the liquid phase C4 stream through the way of dissolution, and was fed with the circulated C4 stream 1109 of the reactor into the first-stage reactor, the circulated C4 stream 1109 had a flow rate of 32000 kg/h, and the hydrogen gas dissolved therein had a flow rate of 20.0 kg/h; a small part of the hydrogen gas was fed through the first-stage mixer 14 provided at an inlet of the first-stage reactor 15, and had a flow rate of 17.0 kg/h.

The results of main streams were shown in Table 2.

TABLE 2

| Stream No. | 1101 | 1102 | 1108 | 1118 | 1201 | 1202 |
|---|---|---|---|---|---|---|
| Phase state | Liquid | Liquid | Liquid | Liquid | Gas | Gas |
| Temperature [° C.] | 40 | 20 | 41.7 | 15 | 15.8 | 15.8 |
| Pressure [MPa(g)] | 0.8 | 0.65 | 2.3 | 0.5 | 2.4 | 2.4 |
| Molar composition | % | % | % | % | % | % |
| Hydrogen gas | 0 | 0 | 0 | 0.18 | 95 | 95 |
| Methane | 0 | 0 | 0.50 | 0.55 | 5 | 5 |
| Propane | 0 | 0 | 0.00 | 0.00 | 0 | 0 |
| Propylene | 0.01 | 0 | 0.00 | 0.01 | 0 | 0 |
| Propyne | 0 | 0 | 0.00 | 0.00 | 0 | 0 |
| n-Butane | 2.57 | 4.01 | 3.76 | 3.22 | 0 | 0 |
| iso-Butane | 4.67 | 0.86 | 1.88 | 4.75 | 0 | 0 |
| Butene-1 | 14.2 | 12.06 | 15.36 | 25.20 | 0 | 0 |
| iso-Butylene | 22.05 | 9.52 | 12.84 | 22.55 | 0 | 0 |
| cis-2-Butene | 18.79 | 44.78 | 37.78 | 19.61 | 0 | 0 |
| trans-2-Butene | 3.65 | 12.55 | 11.40 | 8.65 | 0 | 0 |
| 1,3-Butadiene | 6.35 | 8.76 | 10.07 | 14.12 | 0 | 0 |
| 1,2-Butadiene | 4 | 4.06 | 3.16 | 0.72 | 0 | 0 |
| Ethyl acetylene | 4 | 0.41 | 0.34 | 0.13 | 0 | 0 |
| Vinyl acetylene | 17.63 | 0.96 | 0.80 | 0.33 | 0 | 0 |
| n-Pentane | 1.8 | 1.93 | 1.88 | 0.00 | 0 | 0 |
| C5+ | 0.25 | 0.10 | 0.22 | 0 | 0 | 0 |
| Water | 0.02 | 0 | 0 | 0 | 0 | 0 |
| Molar flow rate [kmol/h] | 32.78 | 88.87 | 695.1 | 30.75 | 7.36 | 6.26 |
| Mass flow rate [kg/h] | 1825 | 5000 | 38842 | 1710 | 20 | 17 |

It can be seen from Table 2 that, in the product, the content of 1,3-butadiene was about 7.8% higher than that in the raw material, the content of alkynes was less than 0.5%, and the total conversion rate of alkynes was greater than 97%, which could meet the raw material requirements of the butadiene extraction unit. Compared with Example 1, in this example, because the hydrogen gas was not fed into the reactor completely through the way of dissolution, even distribution of hydrogen gas was slightly worse than that of Example 1, which in turn caused a part of 1,3-butadiene to be consumed due to the hydrogenation reaction, resulting in a decrease in the increased value of the content of 1,3-butadiene in the product compared with the raw material.

Example 3

As shown in FIG. 2, this example provided an apparatus for selective hydrogenation of butadiene extraction tail gas, and the apparatus comprised: a raw material tank 21, a feed pump 22, a coalescer 23, a first-stage mixer 24, a first-stage reactor 25, a first-stage reactor outlet buffer tank 26, a circulated C4 cooler 28, a circulation pump 27, a diluent C4 cooler 29, a second-stage feed cooler 210, a second-stage mixer 211, a second-stage reactor 212, a second-stage reactor outlet buffer tank 213, a stabilization tower 214, a tower top condenser 215, a reflux tank 216, a reflux pump 217, a hydrogen gas feed pipeline 218;

wherein, the bottom of the raw material tank 21, the feed pump 22, the coalescer 23, the first-stage mixer 24, the first-stage reactor 25 and the first-stage reactor outlet buffer tank 26 were connected in sequence;

the second-stage feed cooler 210, the second-stage mixer 211, the second-stage reactor 212, the second-stage reactor outlet buffer tank 213 and the stabilization tower 214 were connected in sequence;

the raw material tank 21 was provided with a butadiene extraction tail gas inlet and a diluent C4 port;

an outlet pipeline of the first-stage reactor outlet buffer tank 26 was divided into three routes, wherein the first route was connected with the circulated C4 cooler 28, the first-stage mixer 27 and the first-stage reactor 25 in sequence; the second route was connected with the second-stage feed cooler 210; the third route was connected with the diluent C4 2102 port of the raw material tank 21;

the hydrogen gas feed pipeline 218 was divided into at least a first pipeline and optionally a second pipeline and a third pipeline, wherein the first pipeline was connected with the first-stage reactor outlet buffer tank 26, the second pipeline was connected with the first-stage mixer 24, and the third pipeline was connected with the second-stage mixer 211, wherein, the hydrogen gas feed pipeline also comprised a pressure-compensating pipeline connected with the second-stage reactor outlet buffer tank 213.

Wherein, the first route of the outlet pipeline of the first-stage reactor outlet buffer tank 26 was connected with the circulated C4 cooler 28 through the circulation pump 27;

the second route of the outlet pipeline of the first-stage reactor outlet buffer tank 26 was connected with the second-stage feed cooler 210 through the circulation pump 27.

A diluent C4 cooler 29 was also provided between an outlet of the first-stage reactor outlet buffer tank 26 and the diluent C4 port of the raw material tank 21.

Wherein, a top outlet of the stabilization tower 214 was connected with the top condenser 215, the reflux tank 216 and the reflux pump 217 in sequence, and an outlet of the reflux pump 217 was connected with an inlet of the stabilization tower 214.

Wherein, the first-stage reactor 25 and the second-stage reactor 212 were both fixed-bed reactors.

The apparatus for selective hydrogenation of butadiene extraction tail gas of this example was used to carry out a method for selective hydrogenation of butadiene extraction tail gas, and the selective hydrogenation method comprised the following steps:

(1) The alkyne-containing tail gas 2101 from butadiene extraction unit (based on the total weight of the alkyne-containing tail gas, main components of the alkyne-containing tail gas were: 58.69% butene, 10.35% butadiene, 17.65% ethyl acetylene and 4.00% vinyl acetylene, 2.05% C5 and higher, 0.02% water) was fed into the raw material tank 21, and the alkyne-containing tail gas 2101 in the raw material tank 21 was diluted with the diluent C4 stream 2102 from the first-stage reactor outlet buffer tank 26; wherein, the alkyne-containing tail gas 2101 had a flow rate of 1825 kg/h, the raw material tank 21 had an operating pressure of 0.5 MPaG, the diluent C4 stream 2102 had a flow rate of 3000 kg/h; after dilution, in the raw material tank, the content of liquid phase vinyl acetylene was 6.85%, and the content of vinyl acetylene in the gas phase was 3.18%.

(2) The diluted raw material in the raw material tank 21 was pressurized by the feed pump 22 to 2.7 MPaG, then mixed with the circulated C4 stream 2109 from the first-stage reactor outlet buffer tank 26, and then fed into the first-stage mixer 24, wherein it was mixed with hydrogen gas (i.e., to obtain the first-stage reactor raw material 2107), and fed into the first-stage reactor 25 to carry out the first-stage hydrogenation reaction, and the first-stage reaction stream (the first-stage reactor product 2108) obtained in the reaction was fed into the first-stage reactor outlet buffer tank 26; wherein, the circulated C4 stream 2109 had a flow rate of 85000 kg/h, the mixed C4 feed had a flow rate of 89759 kg/h, and the temperature was 35° C.

The hydrogen gas required for the reaction in the first-stage reactor 25 was allocated and fed through a first feeding mode; the first feeding mode comprised: all the hydrogen gas required for the reaction was fed through the first-stage reactor outlet buffer tank 26, and then fed into the first-stage reactor 25 through the first route at the outlet of the first-stage reactor outlet buffer tank 26; wherein, the hydrogen gas required for the reaction in the first-stage reactor 25 controlled the pressure of the reaction system through pressure compensation and the pressure was 2.2 MPaG, and the hydrogen gas entered the liquid phase C4 stream by the way of dissolution, and was fed with the circulated C4 stream 2109 of the first-stage reactor 25 into the first-stage reactor 25, the circulated C4 stream 2109 had a flow rate of 85000 kg/h, the hydrogen gas dissolved therein had a flow rate of 48.2 kg/h, and the hydrogen gas was no longer fed into the first-stage mixer 24.

(3) The first-stage reactor outlet buffer tank 26 had no gas-phase discharge, and the liquid-phase product was divided into three streams, wherein the first stream was used as the circulated C4 stream 2109 and returned to the first-stage reactor 25, the second stream was used as a second-stage reactor feed and fed into the second-stage reactor 212 through the second-stage feed cooler 210 and the second-stage mixer 211 to carry out the second-stage hydrogenation reaction, and the third stream was used as the diluent C4 stream 2102 and fed into the raw material tank 21; wherein, the second stream used as the second-stage reactor feed (the second-stage reactor raw material 2115) had a flow rate of 1807 kg/h, and a temperature of 35° C. The hydrogen gas required for the reaction in the second-stage reactor 212 was allocated and fed through a third feeding mode; the third feeding mode comprised: all the hydrogen gas required for the reaction was fed through the first-stage reactor outlet buffer tank 26, and then fed into the second-stage reactor 212 through a second route at the outlet of the first-stage reactor outlet buffer tank 26, and this part of the hydrogen gas fed by the way of dissolution had a flow rate of 1.8 kg/h; the second-stage mixer provided at the inlet of the second-stage reactor was no longer provided with hydrogen gas.

(4) The second-stage reaction stream (the second-stage reactor product 116) obtained by the reaction in the second-stage reactor 212 was fed into the stabilization tower 214 through the second-stage reactor outlet buffer tank 213, and separated by the stabilization tower 214 to recover a C4 olefin product 2122 as a side-draw; wherein, the second-stage reaction stream obtained by the reaction in the second-stage reactor was fed into the second-stage reactor outlet buffer tank, the pressure was controlled at 2.2 MPaG, the C4 stream at the bottom of the second-stage reactor outlet buffer tank was fed into the stabilization tower to remove non-condensable gas 2121 from the tower top of the stabilization tower, to remove heavy components 2123 from the tower kettle, and to obtain a high-quality C4 olefin product 2122 as a side-draw, and the C4 olefin product 2122 had a flow rate of 1710 kg/h. The stabilization tower 214 had a theoretical plate number of 20, a tower top temperature of 71.5° C., a tower kettle temperature of 126° C., and a reflux (the stabilization tower reflux 2120) flow rate of 2500 kg/h. The stabilization tower 214 had an operating pressure of 0.85 MPaG.

Wherein, the first-stage reactor 25 and the second-stage reactor 212 each independently had an inlet temperature of 40° C., the first-stage reactor had a liquid space velocity of 20 $h^{-1}$, and the second-stage reactor had a liquid space velocity of 3 $h^{-1}$; the first-stage reactor 25 and the second-stage reactor 212 each independently had a pressure of 2.20 MPaG that was controlled by a pressure-compensating hydrogen gas of each reactor outlet buffer tank.

The results of main streams were shown in Table 3.

The catalyst used in Examples 3 and 4 was: based on the total weight of the catalyst, the catalyst was composed of the following components: Pd at a content of 0.3 wt %, metallic silver at a content of 0.3 wt %, and a carrier as the balance, in which the carrier was alumina.

The calculation method of olefin yield in Examples 3 and 4 was carried out according to following Formula 1:

Formula 1

$$\text{olefin yield} = \frac{\text{content of butenes at outlet of second-stage reactor (mol \%)}}{\text{sum of contents of butenes + butadienes + alkynes in raw material (mol \%)}} \times 100\%$$

in Formula 1:

butenes include butene-1, cis-2-butene, trans-2-butene and isobutene;

butadienes include 1,3-butadiene and 1,2-butadiene;

alkynes include ethyl acetylene and vinyl acetylene;

content of butenes at outlet of second-stage reactor (mol %): sum of the normalized mol % contents of butene-1, cis-2-butene, trans-2-butene and isobutene after deducting the contents of hydrogen gas and methane from outlet composition of the second-stage reactor.

TABLE 3

| Stream No. | 2101 | 2108 | 2116 | 2122 | 2201 |
|---|---|---|---|---|---|
| Gas phase fraction | 0.00 | 0.00 | 0.00 | 0.00 | 1.00 |
| Temperature [° C.] | 40.0 | 46.9 | 50.4 | 74.0 | 15.8 |
| Pressure [MPa(g)] | 0.80 | 2.20 | 2.20 | 0.88 | 2.40 |
| Molar composition | % | % | % | % | % |
| Hydrogen gas | 0.00 | 0.26 | 0.37 | 0.00 | 95.00 |
| Methane | 0.00 | 1.64 | 1.69 | 0.05 | 5.00 |
| Propane | 0.00 | 0.00 | 0.00 | 0.00 | 0.00 |
| Propylene | 0.01 | 0.01 | 0.01 | 0.00 | 0.00 |
| propyne | 0.00 | 0.00 | 0.00 | 0.00 | 0.00 |
| n-Butane | 2.57 | 2.60 | 2.92 | 3.06 | 0.00 |
| iso-Butane | 4.67 | 4.52 | 4.52 | 4.62 | 0.00 |
| Betene-1 | 14.20 | 32.69 | 26.20 | 27.19 | 0.00 |
| iso-butene | 22.05 | 21.52 | 21.48 | 22.25 | 0.00 |
| cis-2-Butene | 18.79 | 19.89 | 22.59 | 23.65 | 0.00 |
| trans-2-Butene | 3.65 | 14.31 | 18.08 | 18.93 | 0.00 |
| 1,3-Butadiene | 6.35 | 0.10 | <30 ppm | <30 ppm | 0.00 |
| 1,2-Butadiene | 4.00 | 0.07 | | | 0.00 |
| Ethyl acetylene | 4.00 | 0.05 | <5 ppm | <5 ppm | 0.00 |
| Vinyl acetylene | 17.63 | 0.19 | <5 ppm | <5 ppm | 0.00 |
| n-Pentane | 1.80 | 1.81 | 1.80 | 0.24 | 0.00 |
| C5+ | 0.25 | 0.32 | 0.32 | 0.00 | 0.00 |
| Water | 0.02 | 0.00 | 0.00 | 0.00 | 0.00 |
| Molar flow rate [kmol/h] | 32.78 | 1605.46 | 32.36 | 30.39 | 17.74 |
| Mass flow rate [kg/h] | 1825.00 | 89758.80 | 1807.00 | 1710.00 | 48.20 |

It can be seen from Table 3 that, in the product, the content of alkynes was less than 5 ppm, and the content of dienes was less than 30 ppm. Based on the outlet composition of the second-stage reactor, the olefin yield of the selective hydrogenation reaction reached 99.5%.

Example 4

As shown in FIG. 2, compared with Example 3, this example had the following differences:

In step (2), the hydrogen gas required for the reaction in the first-stage reactor 25 was allocated and fed through a second feeding mode; the second feeding mode comprised: a part of the hydrogen gas required for the reaction was fed through the first-stage reactor outlet buffer tank 26, and then fed into the first-stage reactor 25 through the first route of the outlet of the first-stage reactor outlet buffer tank 26; the other part of the hydrogen gas was fed through the first-stage mixer 24, and then fed into the first-stage reactor 25; wherein most of the hydrogen gas was fed through the first-stage reactor outlet buffer tank 26, and this part of hydrogen gas controlled the pressure of the reaction system through pressure compensation, simultaneously entered the liquid-phase C4 stream by the way of dissolution, and was fed with the circulated C4 stream 2109 of the first-stage reactor 25 into the reactor, the circulated C4 stream 2109 had a flow rate of 52000 kg/h, and the hydrogen gas dissolved therein had a flow rate of 29.0 kg/h; a small part of the hydrogen gas is fed through the first-stage mixer 24 provided at the inlet of the first-stage reactor 25, and had a flow rate of 23.0 kg/h.

In step (3), the hydrogen gas required for the reaction in the second-stage reactor 212 was allocated and fed through a fourth feeding mode; the fourth feeding mode comprised: a part of the hydrogen gas required for the reaction was fed through the first-stage reactor outlet buffer tank 26, and then fed into the second-stage reactor 212 through the second route of the outlet of the first-stage reactor outlet buffer tank 26, and the hydrogen gas fed by the way of dissolution had a flow rate of 1.8 kg/h; the other part of the hydrogen gas was fed through the second-stage mixer 211, and then fed into the second-stage reactor 212; wherein, the hydrogen gas fed through the second-stage mixer 211 at the inlet of the second-stage reactor 212 had a flow rate of 1.5 kg/h.

The results of main streams were shown in Table 4.

TABLE 4

| Stream No. | 2101 | 2108 | 2116 | 2122 | 2201 | 2202 | 2203 |
|---|---|---|---|---|---|---|---|
| Gas phase fraction | 0.00 | 0.00 | 0.00 | 0.00 | 1.00 | 1.00 | 1.00 |
| Temperature [° C.] | 40.0 | 54.4 | 71.6 | 74.3 | 15.8 | 15.8 | 15.8 |
| Pressure [MPa(g)] | 0.80 | 2.20 | 2.20 | 0.88 | 2.40 | 2.40 | 2.40 |
| Molar composition | % | % | % | % | % | % | % |
| Hydrogen gas | 0.00 | 0.42 | 0.25 | 0.00 | 95.00 | 95.00 | 95.00 |
| Methane | 0.00 | 1.74 | 1.88 | 0.06 | 5.00 | 5.00 | 5.00 |
| Propane | 0.00 | 0.00 | 0.00 | 0.00 | 0.00 | 0.00 | 0.00 |
| Propylene | 0.01 | 0.01 | 0.01 | 0.01 | 0.00 | 0.00 | 0.00 |
| Propyne | 0.00 | 0.00 | 0.00 | 0.00 | 0.00 | 0.00 | 0.00 |
| n-Butane | 2.57 | 5.72 | 7.94 | 8.31 | 0.00 | 0.00 | 0.00 |
| iso-Butane | 4.67 | 5.16 | 5.16 | 5.27 | 0.00 | 0.00 | 0.00 |
| Betene-1 | 14.20 | 29.48 | 21.78 | 22.57 | 0.00 | 0.00 | 0.00 |
| iso-butene | 22.05 | 20.85 | 20.85 | 21.57 | 0.00 | 0.00 | 0.00 |
| cis-2-Butene | 18.79 | 19.86 | 22.34 | 23.42 | 0.00 | 0.00 | 0.00 |
| trans-2-Butene | 3.65 | 14.23 | 17.67 | 18.50 | 0.00 | 0.00 | 0.00 |
| 1,3-Butadiene | 6.35 | 0.08 | <30 ppm | <30 ppm | 0.00 | 0.00 | 0.00 |
| 1,2-Butadiene | 4.00 | 0.11 | | | 0.00 | 0.00 | 0.00 |

TABLE 4-continued

| Stream No. | 2101 | 2108 | 2116 | 2122 | 2201 | 2202 | 2203 |
|---|---|---|---|---|---|---|---|
| Ethyl acetylene | 4.00 | 0.01 | <5 ppm | <5 ppm | 0.00 | 0.00 | 0.00 |
| Vinyl acetylene | 17.63 | 0.19 | <5 ppm | <5 ppm | 0.00 | 0.00 | 0.00 |
| n-Pentane | 1.80 | 1.80 | 1.80 | 0.28 | 0.00 | 0.00 | 0.00 |
| C5+ | 0.25 | 0.31 | 0.31 | 0.00 | 0.00 | 0.00 | 0.00 |
| Water | 0.02 | 0.00 | 0.00 | 0.00 | 0.00 | 0.00 | 0.00 |
| Molar flow rate [kmol/h] | 32.78 | 1016.49 | 32.27 | 30.32 | 10.67 | 8.46 | 0.55 |
| Mass flow rate [kg/h] | 1825.00 | 56775.06 | 1805.56 | 1710.00 | 29.00 | 23.00 | 1.50 |

It can be seen from Table 4 that, in the product, the content of alkynes and dienes was lower than 30 ppm, and the olefin yield reached 93.0% based on the outlet composition of the second-stage reactor. In this example, because the hydrogen gas was not fed into the reactor completely through the way of dissolution, the even distribution of hydrogen gas was slightly worse than that of Example 3, which in turn caused some monoolefins to continuously undergo hydrogenation reaction with hydrogen gas to form alkanes, resulting in a slight decrease in the selectivity of olefins.

Example 5

As shown in FIG. 3, the present example provided an apparatus for selective hydrogenation of butadiene extraction tail gas, and the apparatus comprised: a blower suction tank 31, a blower 32, a liquefaction condenser 33, a C4 collection tank 34, a booster pump 35, a water-washing tower 36, a raw material tank 37, a feed pump 38, a coalescer 39, a first-stage mixer 310, a first-stage reactor 311, a first-stage reactor outlet buffer tank 312, a circulation pump 313, a circulated cooler 314, a stabilization tower 315, a hydrogen gas feed pipeline 320, a tower top condenser 316, a reflux tank 317, a reflux pump 318 and a tail gas condenser 319;

wherein, the blower suction tank 31, the blower 32, the liquefaction condenser 33, the C4 collection tank 34, the booster pump 35 and the water-washing tower 36 were connected in sequence; the blower suction tank 31 was provided with a butadiene extraction tail gas inlet and a diluent C4 port;

a C4 raw material outlet of the water-washing tower 36, the raw material tank 37, the feed pump 38, the coalescer 39, the first-stage mixer 310, the first-stage reactor 311 and the first-stage reactor outlet buffer tank 312 were connected in sequence; wherein, the water-washing tower 36 was provided at top with a washing water inlet and a C4 raw material outlet, and provided at bottom with a liquefied C4 raw material inlet and a washing water outlet, and the booster pump 35 was connected with the liquefied C4 raw material inlet;

the outlet pipeline of the first-stage reactor outlet buffer tank 312 was divided into two routes, wherein the first route was connected with the circulated cooler 314, the mixer 310 and the hydrogenation reactor 11 in sequence; the second route was connected with the stabilization tower 315; wherein, the first route of the outlet pipeline of the first-stage reactor outlet buffer tank 312 was connected with the circulated cooler 314 through the circulation pump 313;

the hydrogen gas feed pipeline 320 was divided into at least a first pipeline and optionally a second pipeline, wherein the first pipeline was connected with the first-stage reactor outlet buffer tank 312, and the second pipeline was connected with the first-stage mixer 310;

wherein, an outlet of the stabilization tower 315 was connected with the diluent C4 port of the blower suction tank 31.

Wherein, the top outlet of the stabilization tower 315 was connected with the tower top condenser 316 and the reflux tank 317 in sequence; an outlet of the reflux tank 317 was connected with the tail gas condenser 319, and an outlet of the tail gas condenser 319 was connected with an inlet of the reflux tank 317; another outlet of the reflux tank 317 was connected with the reflux pump 318, and an outlet of the reflux pump 318 was connected with an inlet of the stabilization tower 315.

Wherein, the first-stage reactor 311 was a fixed-bed reactor.

The apparatus for selective hydrogenation of butadiene extraction tail gas of this example was used to carry out a method for selective hydrogenation of butadiene extraction tail gas, and the selective hydrogenation method comprised:

(1) An alkyne-containing tail gas 3101 from butadiene extraction unit (based on the total weight of the alkyne-containing tail gas, the main components of the alkyne-containing tail gas were: 58.69% butene, 10.35% butadiene, 17.65% ethyl acetylene and 4.00% vinyl acetylene, 2.05% C5 and higher, 0.02% water) had a flow rate of 1825 kg/h, and a pressure of 10 Kpa; before the tail gas entered the blower suction tank 31, it was diluted with a gas phase C4 product (i.e. diluent C4 stream 3119) produced as a side-draw from the stabilization tower, and the diluent C4 stream 3119 had a flow rate of 5000 kg/h. The tail gas was fed into the blower suction tank 31, its gas phase was pressurized to 80 KPa by the blower 32, and the C4 raw material was cooled to 5° C. by the liquefaction condenser 33 using a cooling agent and then liquefied, and then fed into the C4 collection tank 34, followed by pressurization by the booster pump 35 and being fed into the water-washing tower 36 from the bottom of the water-washing tower 36 to remove the impurities entrained in the butadiene tail gas, and then fed into the raw material tank 37 through the top of the water-washing tower 36. The water-washing tower 36 had an operating pressure of 0.7 MPaG, a washing water temperature of 40° C., and a flow rate of 8000 kg/h; the raw material tank had a pressure of 0.65 MPaG.

(2) The C4 raw material in the raw material tank 37 was pressurized to 2.7 MPaG by the feed pump 38 (to obtain the C4 feed 3105), then merged with the circulated C4 stream 3109 from the first-stage reactor outlet buffer tank 312, and then fed into the first-stage mixer 310, wherein it was mixed with hydrogen gas (i.e., to obtain the reactor raw material 3107), and then fed into the first-stage reactor 311 for hydrogenation reaction, and the first-stage reaction stream obtained by the reaction (the first-stage reactor product 3108) was fed into the first-stage reactor outlet buffer tank 312;

wherein, the circulated C4 stream 3109 had a flow rate of 45000 kg/h, the mixed C4 feed had a flow rate of 51826 kg/h, the first-stage reactor had an inlet temperature of 20° C., and a liquid space velocity of 20 $h^{-1}$.

The hydrogen gas required for the reaction in the first-stage reactor 311 was allocated and fed through a first feeding mode; the first feeding mode comprised: all the hydrogen gas required for the reaction was fed through the reactor outlet buffer tank 312, and then fed into the first-stage reactor 311 through the first route at the outlet of the reactor outlet buffer tank 312; wherein, the hydrogen gas required for the reaction in the first-stage reactor 311 controlled the pressure of the reaction system through pressure compensation, and the pressure was 2.3 MPaG, and the hydrogen gas was fed into the liquid-phase C4 stream by the way of dissolution, and fed with the circulated C4 stream 3109 of the reactor into the first-stage reactor 311, the circulated C4 stream 3109 had a flow rate of 45000 kg/h, the hydrogen gas dissolved therein had a flow rate of 34.0 kg/h, and the first-stage mixer 310 provided at the inlet of the first-stage reactor 311 was not provided with hydrogen gas.

(3) The first-stage reactor outlet buffer tank 312 had no gas-phase discharge, and the liquid phase product was divided into two streams, wherein the first stream was used as the circulated C4 stream 3109 and returned to the hydrogenation reactor 311, and the second stream was used as the feed 3112 to the stabilization tower 315, and had a flow rate of 6853 kg/h and a temperature of 35° C.

(4) The first-stage reaction stream (the first-stage reactor product 3108) obtained by the reaction in the first-stage reactor 311 was fed into the stabilization tower 315 through the first-stage reactor outlet buffer tank 312, and separated by the stabilization tower 315 to produce the C4 hydrogenation product 3118; wherein, the stabilization tower 315 was used to remove non-condensable gas 3116 from the tower top, to remove heavy components 3117 from the tower kettle, to recover the liquid-phase C4 hydrogenation product 3118 rich in 1,3-butadiene and monoolefins from the tower top, and to recover as a side-draw the gas-phase diluent C4 stream 3119 that is used for diluting raw materials and at a flow rate of 5000 kg/h. The stabilization tower 15 had a theoretical plate number of 30, a side-draw position at the $25^{th}$ theoretical plate, an operating pressure of 0.5 MPaG, a tower top temperature of 56.7° C., a tower kettle temperature of 100.2° C., and a reflux (the stabilization tower reflux 3115) flow rate of 5600 kg/h.

The results of main streams were shown in Table 5.

The catalyst used in Examples 5 and 6 was: based on the total weight of the catalyst, the catalyst was composed of the following components: Pd at a content of 0.3 wt %, silver metal at a content of 0.3 wt %, and a carrier as the balance; in which the carrier was alumina.

TABLE 5

| Stream No. | 3101 | 3103 | 3108 | 3118 | 3119 | 3201 | 3202 |
|---|---|---|---|---|---|---|---|
| Phase state | Gas | Liquid | Liquid | Liquid | Gas | Gas | Gas |
| Temperature [° C.] | 40 | 5 | 36.1 | 15 | 51.7 | 15.8 | 15.8 |
| Pressure [MPa(g)] | 0.01 | 0.08 | 2.3 | 0.5 | 0.01 | 2.4 | 2.4 |
| Molar composition | % | % | % | % | % | % | % |
| Hydrogen gas | 0 | 0 | 0 | 0.18 | 0 | 95 | 95 |
| Methane | 0 | 0 | 0.44 | 0.52 | 0 | 5 | 5 |
| Propane | 0 | 0 | 0 | 0 | 0 | 0 | 0 |
| Propylene | 0.01 | 0 | 0 | 0.01 | 0 | 0 | 0 |
| Propyne | 0 | 0 | 0 | 0 | 0 | 0 | 0 |
| n-Butane | 2.57 | 3 | 3.02 | 2.67 | 3.17 | 0 | 0 |
| iso-Butane | 4.67 | 1.84 | 1.83 | 4.72 | 0.8 | 0 | 0 |
| Butene-1 | 14.2 | 11.3 | 13.83 | 22.10 | 10.23 | 0 | 0 |
| iso-butene | 22.05 | 12.48 | 12.42 | 22.4 | 8.95 | 0 | 0 |
| cis-2-Butene | 18.79 | 36.16 | 36.14 | 19.35 | 42.54 | 0 | 0 |
| trans-2-Butene | 3.65 | 7.18 | 8.2 | 6.41 | 8.48 | 0 | 0 |
| 1,3-Butadiene | 6.35 | 9.76 | 12.57 | 19.37 | 11 | 0 | 0 |
| 1,2-Butadiene | 4 | 8.85 | 7.73 | 1.8 | 10.63 | 0 | 0 |
| Ethyl acetylene | 4 | 1.37 | 0.3 | 0.14 | 0.4 | 0 | 0 |
| Vinyl acetylene | 17.63 | 5.61 | 0.87 | 0.33 | 1.18 | 0 | 0 |
| n-Pentane | 1.8 | 2.39 | 2.38 | 0 | 2.61 | 0 | 0 |
| C5+ | 0.25 | 0.07 | 0.17 | 0 | 0.01 | 0 | 0 |
| Water | 0.02 | 0.01 | 0 | 0 | 0 | 0 | 0 |
| Molar flow rate [kmol/h] | 32.78 | 121.88 | 925.2 | 30.84 | 89.1 | 12.51 | 0 |
| Mass flow rate [kg/h] | 1825 | 6825 | 51826.91 | 1712.2 | 5000 | 34 | 0 |

It can be seen from Table 5 that, in the product, the content of 1,3-butadiene was about 13% higher than that in the raw material, the content of alkynes was less than 0.5%, and the total conversion rate of alkynes was greater than 97%, which could meet the raw material requirements of the butadiene extraction unit.

Example 6

As shown in FIG. 3, compared with Example 5, this example had the following differences:

In step (2), the hydrogen gas required for the reaction in the first-stage reactor 311 was allocated and fed through a second feeding mode; the second feeding mode comprised: a part of the hydrogen gas required for the reaction was fed through the first-stage reactor outlet buffer tank 312, and then fed into the first-stage reactor 311 through the first route at the outlet of the first-stage reactor outlet buffer tank 312; the other part of the hydrogen gas was fed through the first-stage mixer 310, and then fed into the first-stage reactor 311; wherein, most of the hydrogen gas was allocated through the first-stage reactor outlet buffer tank 312, and this part of the hydrogen gas controlled the pressure of the reaction system through pressure compensation, and at the same time entered the liquid-phase C4 stream through the way of dissolution, and entered the first-stage reactor along with the circulated C4 stream 3109 of the reactor, and the circulated C4 stream 3109 had a flow rate of 32000 kg/h, the hydrogen gas dissolved therein had a flow rate of 20.0 kg/h; a small part of the hydrogen gas is fed through the first-stage mixer 310 provided at the inlet of the first-stage reactor 311, and had a flow rate of 15.5 kg/h.

The results of main streams were shown in Table 6.

TABLE 6

| Stream No. | 3101 | 3103 | 3108 | 3118 | 3119 | 3201 | 3202 |
|---|---|---|---|---|---|---|---|
| Phase state | Gas | Liquid | Liquid | Liquid | Gas | Gas | Gas |
| Temperature [° C.] | 40 | 5 | 41.3 | 15 | 51.5 | 15.8 | 15.8 |
| Pressure [MPa(g)] | 0.01 | 0.08 | 2.3 | 0.5 | 0.01 | 2.4 | 2.4 |
| Molar composition | % | % | % | % | % | % | % |
| Hydrogen gas | 0 | 0 | 0 | 0.18 | 0 | 95 | 95 |
| Methane | 0 | 0 | 0.48 | 0.54 | 0 | 5 | 5 |
| Propane | 0 | 0 | 0.00 | 0.00 | 0 | 0 | 0 |
| Propylene | 0.01 | 0 | 0.00 | 0.01 | 0 | 0 | 0 |
| Propyne | 0 | 0 | 0.00 | 0.00 | 0 | 0 | 0 |
| n-Butane | 2.57 | 3.02 | 3.08 | 2.69 | 3.17 | 0 | 0 |
| iso-Butane | 4.67 | 1.85 | 1.87 | 4.75 | 0.8 | 0 | 0 |
| Butene-1 | 14.2 | 11.67 | 14.32 | 23.66 | 10.23 | 0 | 0 |
| iso-butene | 22.05 | 12.52 | 12.68 | 22.58 | 8.95 | 0 | 0 |
| cis-2-Butene | 18.79 | 36.30 | 36.89 | 19.49 | 42.54 | 0 | 0 |
| trans-2-Butene | 3.65 | 7.59 | 8.48 | 6.51 | 8.48 | 0 | 0 |
| 1,3-Butadiene | 6.35 | 9.63 | 11.75 | 17.26 | 11 | 0 | 0 |
| 1,2-Butadiene | 4 | 8.30 | 7.77 | 1.80 | 10.63 | 0 | 0 |
| Ethyl acetylene | 4 | 1.31 | 0.27 | 0.13 | 0.4 | 0 | 0 |
| Vinyl acetylene | 17.63 | 5.39 | 0.75 | 0.36 | 1.18 | 0 | 0 |
| n-Pentane | 1.8 | 2.35 | 1.55 | 0.00 | 2.61 | 0 | 0 |
| C5+ | 0.25 | 0.07 | 0.13 | 0 | 0.01 | 0 | 0 |
| Water | 0.02 | 0.01 | 0 | 0 | 0 | 0 | 0 |
| Molar flow rate [kmol/h] | 32.78 | 121.84 | 693.1 | 30.81 | 89 | 7.36 | 5.70 |
| Mass flow rate [kg/h] | 1825 | 6825 | 38826.91 | 1710 | 5000 | 20 | 15.5 |

It can be seen from Table 6 that, in the product, the content of 1,3-butadiene was about 11% higher than that in the raw material, the content of alkynes was less than 0.5%, and the total conversion rate of alkynes was greater than 97%, which could meet the raw material requirements of the butadiene extraction unit. Compared with Example 5, in this example, because the hydrogen gas was not fed into the reactor completely through the way of dissolution, the even distribution of hydrogen gas was slightly worse than that of Example 5, which in turn caused a part of 1,3-butadiene to undergo hydrogenation reaction and to be consumed, resulting in a decrease in the increased value of the content of 1,3-butadiene in the product compared with the raw material.

The foregoing description has exemplarily described various embodiments of the present invention, but is not exhaustive, and the present invention is not limited to the disclosed examples. Many modifications and alterations will be apparent to those of ordinary skill in the art without departing from the scope and spirit of the described examples.

The invention claimed is:

1. A method for selective hydrogenation of butadiene extraction tail gas, comprising:

operation (1) feeding an alkyne-containing tail gas from a butadiene extraction unit into a raw material tank, and optionally removing impurities entrained in the alkyne-containing tail gas before being fed into the raw material tank;

operation (2) pressuring a C4 raw material in the raw material tank by a feed pump to a pressure required for reaction, then merging the C4 raw material with a circulated C4 stream from a first-stage reactor outlet buffer tank and feeding the merged stream into a first-stage mixer, mixing the merged stream with hydrogen gas in the first-stage mixer, and feeding the mixture into the first-stage reactor to undergo a first-stage hydrogenation reaction to obtain a first-stage reaction stream, and feeding the first-stage reaction stream into the first-stage reactor outlet buffer tank;

wherein the hydrogen gas required for the reaction in the first-stage reactor is fed through a first feeding mode or a second feeding mode:

wherein the first feeding mode comprises: feeding all the hydrogen gas required for the reaction through the first-stage reactor outlet buffer tank, and then into the first-stage reactor through a first route at an outlet of the first-stage reactor outlet buffer tank;

wherein the second feeding mode comprises: feeding a part of the hydrogen gas required for the reaction through the first-stage reactor outlet buffer tank, and then into the first-stage reactor through the first route at an outlet of the first-stage reactor outlet buffer tank; and feeding the other part of the hydrogen gas through the first-stage mixer, and then into the first-stage reactor;

operation (3) dividing a liquid-phase product obtained from the first-stage reactor outlet buffer tank into at least two streams, wherein there is no gas-phase discharge from the first-stage reactor outlet buffer tank, wherein the first stream is returned to the first-stage reactor as the circulated C4 stream, and the second stream is used as a feed to a stabilization tower or subjected to further hydrotreatment prior to being fed into the stabilization tower;

operation (4) recovering a C4 hydrogenation product after separation in the stabilization tower.

2. The method for selective hydrogenation of butadiene extraction tail gas according to claim 1, wherein, in operation (1), the alkyne-containing tail gas is diluted with a side-draw diluent C4 stream from the stabilization tower; or wherein, in operation (1), the alkyne-containing tail gas is diluted with a diluent C4 stream from the first-stage reactor outlet buffer tank.

3. The method for selective hydrogenation of butadiene extraction tail gas according to claim 1, wherein, in operation (2), in the second feeding mode, the mass ratio of the part of the hydrogen gas required for the reaction to the hydrogen gas required for the first-stage hydrogenation reaction is not less than 0.3, and the hydrogen gas required for the first-stage hydrogenation reaction is the sum of the part of the hydrogen gas required for the reaction and the other part of the hydrogen gas.

4. The method for selective hydrogenation of butadiene extraction tail gas according to claim 1, wherein, in operation (3), the further hydrotreatment of the second stream prior to being fed into the stabilization tower comprises: feeding the second stream into a second-stage reactor as a feed through a second-stage feed cooler and a second-stage mixer to carry out a second-stage hydrogenation reaction, and then a second-stage reaction stream obtained by the reaction in the second-stage reactor passing through a second-stage reactor outlet buffer tank and entering the stabilization tower.

5. The method for selective hydrogenation of butadiene extraction tail gas according to claim 4, wherein, in operation (3), the hydrogen gas required for the reaction in the second-stage reactor is fed through a third feeding mode or a fourth feeding mode;

wherein the third feeding mode comprises: feeding all the hydrogen gas required for the reaction through the first-stage reactor outlet buffer tank, and then into the second-stage reactor through a second route at the outlet of the first-stage reactor outlet buffer tank;

wherein the fourth feeding mode comprises: feeding a part of the hydrogen gas required for the reaction through the first-stage reactor outlet buffer tank, and then into the second-stage reactor through the second route at the outlet of the first-stage reactor outlet buffer tank; and feeding the other part of the hydrogen gas through the second-stage mixer, and then into the second-stage reactor.

6. The method for selective hydrogenation of butadiene extraction tail gas according to claim 5, wherein, in operation (3), in the fourth feeding mode, the mass ratio of the part of the hydrogen gas required for the reaction to the hydrogen gas required for the second-stage hydrogenation reaction is not less than 0.3, and wherein the hydrogen gas required for the second-stage hydrogenation reaction is the sum of the part of the hydrogen gas required for the reaction and the other part of the hydrogen gas.

7. The method for selective hydrogenation of butadiene extraction tail gas according to claim 1, wherein, in operation (1), the raw material tank has an operating pressure ranging from 0.1 MPaG to 1.0 MPaG; and/or wherein, in operation (2), the C4 raw material in the raw material tank is pressurized to a pressure ranging from 1.0 MPaG to 4.0 MPaG by the feed pump, and the mass flow ratio of the circulated C4 stream to the raw material is 5-30:1; the first-stage reactor has an inlet temperature ranging from 5° C. to 60° C., and a liquid space velocity ranging from $1h^{-1}$ to $50h^{-1}$; the first-stage reactor has a pressure that is controlled by a pressure-compensating hydrogen gas of the first-stage reactor outlet buffer tank, and the reaction pressure ranges from 1.0 MPaG to 4.0 MPaG; and/or wherein, in operation (4), the stabilization tower has an operating pressure ranging from 0.4 MPaG to 1.2 MPaG, a theoretical plate number ranging from 10 to 40, and a side-draw theoretical plate position at 5 to 35.

8. The method for selective hydrogenation of butadiene extraction tail gas according to claim 1, wherein, in operation (1), the alkyne-containing tail gas from the butadiene extraction unit is fed into the raw material tank without removing the impurities from the alkyne-containing tail gas;

in operation (3), the liquid-phase product from the first-stage reactor outlet buffer tank are divided into at least two streams, wherein there is no gas-phase discharge from the first-stage reactor outlet buffer tank, wherein the first stream is returned to the first-stage reactor as the circulated C4 stream, and the second stream is used as a feed to the stabilization tower;

in operation (4), the first-stage reaction stream obtained from the reaction in the first-stage reactor is fed into the stabilization tower through the first-stage reactor outlet buffer tank, and separated by the stabilization tower to recover a C4 hydrogenation product.

9. The method for selective hydrogenation of butadiene extraction tail gas according to claim 8, wherein, in operation (1), the alkyne-containing tail gas is diluted with a side-draw diluent C4 stream from the stabilization tower; and/or in operation (1), the raw material tank has an operating pressure ranging from 0.5 MPaG to 1.0 MPaG;

in operation (2), the diluted C4 raw material is pressurized by the feed pump to a pressure ranging from 1.0 MPaG to 4.0 MPaG, and the mass flow ratio of the circulated C4 stream to the diluted C4 raw material is 5-30:1;

the first-stage reactor has an inlet temperature ranging from 5° C. to 60° C., and a liquid space velocity ranging from 1 $h^{-1}$ to 40 $h^{-1}$; the first-stage reactor has a pressure that is controlled by the pressure-compensating hydrogen gas of the first-stage reactor outlet buffer tank, and the reaction pressure is ranging from 1.0 MPaG to 4.0 MPaG;

in operation (4), the stabilization tower has an operating pressure ranging from 0.4 MPaG to 1.0 MPaG, a theoretical plate number ranging from 10 to 40, and a side-draw theoretical plate position at 5 to 35.

10. The method for selective hydrogenation of butadiene extraction tail gas according to claim 1, wherein, in operation (1), the alkyne-containing tail gas from the butadiene extraction unit is fed into the raw material tank without removing the impurities from the alkyne-containing tail gas;

wherein, in operation (1), the alkyne-containing tail gas is fed into the raw material tank, and the alkyne-containing tail gas in the raw material tank is diluted with the diluent C4 stream from the first-stage reactor outlet buffer tank;

in operation (3), the first-stage reactor outlet buffer tank has no gas-phase discharge, and the liquid-phase product is divided into three streams, wherein the first stream is returned to the first-stage reactor as the circulated C4 stream, the second stream is used as a feed to the second-stage reactor and fed into the second-stage reactor through the second-stage feed cooler and the second-stage mixer to carry out the second-stage hydrogenation reaction, and the third stream is fed into the raw material tank as the diluent C4 stream to dilute the alkyne-containing tail gas;

wherein the hydrogen gas required for the reaction of the second-stage reactor is fed through a third feeding mode or a fourth feeding mode:

wherein the third feeding mode comprises: feeding all the hydrogen gas required for the reaction through the first-stage reactor outlet buffer tank, and then into the second-stage reactor through the second route at the outlet of the first-stage reactor outlet buffer tank;

wherein the fourth feeding mode comprises: feeding a part of the hydrogen gas required for the reaction through the first-stage reactor outlet buffer tank, and then into the second-stage reactor through the second route at the outlet of the first-stage reactor outlet buffer tank; and feeding the other part of the hydrogen gas through the second-stage mixer, and then into the second-stage reactor; and wherein in operation (4), the second-stage reaction stream obtained by the reaction in the second-stage reactor is fed into the stabilization tower through the second-stage reactor outlet buffer tank, and separated by the stabilization tower to recover a C4 olefin product as a side-draw.

11. The method for selective hydrogenation of butadiene extraction tail gas according to claim 10, wherein, in operation (1), the raw material tank has an operating pressure ranging from 0.5 MPaG to 1.0 MPaG, and the mass flow ratio of the diluent C4 stream to the alkyne-containing tail gas is 1-5:1;

in operation (2), the diluted C4 raw material is pressurized by the feed pump to a pressure ranging from 1.0 MPaG to 4.0 MPaG, and the mass flow ratio of the circulated C4 stream to the diluted C4 raw material is 5-30:1;

in operation (4), the stabilization tower has an operating pressure ranging from 0.6 MPaG to 1.2 MPaG, a theoretical plate number ranging from 10 to 40, and a side-draw theoretical plate position at 5 to 35;

wherein, the first-stage reactor and the second-stage reactor each independently has an inlet temperature ranging from 20° C. to 60° C., the first-stage reactor has a liquid space velocity ranging from 10 $h^{-1}$ to 50 $h^{-1}$, and the second-stage reactor has a liquid space velocity ranging from 1 $h^{-1}$ to 10 $h^{-1}$; the first-stage reactor and the second-stage reactor each independently has a pressures ranging from 1.0 MPaG to 4.0 MPaG that is controlled by the pressure-compensating hydrogen gas of each reactor outlet buffer tank.

12. The method for selective hydrogenation of butadiene extraction tail gas according to claim 1, wherein, in operation (1), the alkyne-containing tail gas is fed into a water-washing tower to remove the impurities entrained in the alkyne-containing tail gas, and then fed into the raw material tank;

optionally, in operation (1), when the alkyne-containing tail gas is a gas-phase alkyne-containing tail gas, the alkyne-containing tail gas is fed into a blower suction tank, pressurized by a blower, condensed and liquefied by a liquefaction condenser, and then fed into a C4 collection tank, followed by pressurization by a booster pump, and being fed into the water-washing tower to remove the impurities entrained in the alkyne-containing tail gas, and then into the raw material tank.

13. The method for selective hydrogenation of butadiene extraction tail gas according to claim 12, wherein, in operation (3), the first-stage reactor outlet buffer tank has no gas-phase discharge, and the liquid phase product is divided into two streams, wherein the first stream is returned to the first-stage reactor as the circulated C4 stream, and the second stream is used as a feed to the stabilization tower.

14. The method for selective hydrogenation of butadiene extraction tail gas according to claim 13, wherein, in operation (1), the alkyne-containing tail gas is diluted with a side-draw diluent C4 stream from the stabilization tower; and/or wherein, in operation (1), the blower suction tank has an operating pressure ranging from 0 KPa to 20 KPa; the condensed and liquefied gas in the liquefaction condenser has a temperature ranging from 0° C. to 20° C., the liquefaction condenser has a pressure ranging from 50 KPa to 100 KPa; the water-washing tower has an operating pressure ranging from 0.5 MPaG to 1.0 MPaG, the mass ratio of the washing water in the washing tower to the C4 raw material is 1-5:1, and the raw material tank has an operating pressure ranging from 0.5 MpaG to 1.0 MpaG;

in operation (2), the C4 raw material is pressurized by the feed pump to a pressure ranging from 1.0 MPaG to 4.0 MPaG; the first-stage reactor has an inlet temperature ranging from 5° C. to 60° C., and a liquid space velocity ranging from 10 h−1 to 50 h−1; the first-stage reactor has a pressure that is controlled by the pressure-compensating hydrogen gas of the first-stage reactor outlet buffer tank, and the reaction pressure is ranging from 1.0 MPaG to 4.0 MPaG;

in operation (4), the stabilization tower has an operating pressure ranging from 0.4 MPaG to 1.0 MPaG, a theoretical plate number ranging from 10 to 40, and a side-draw theoretical plate position at 5 to 35.

15. An apparatus for selective hydrogenation of butadiene extraction tail gas, which is configured to carry out the method according to claim 1, characterized in that the apparatus comprises: a raw material tank, a feed pump, a coalescer, a first-stage mixer, a first-stage reactor, a first-stage reactor outlet buffer tank, a circulated C4 cooler, a stabilization tower and a hydrogen gas feed pipeline;

the raw material tank, the feed pump, the coalescer, the first-stage mixer, the first-stage reactor and the first-stage reactor outlet buffer tank are connected in sequence;

wherein an outlet pipeline of the first-stage reactor outlet buffer tank is divided into at least two routes, wherein the first route is connected with the circulated C4 cooler, the first-stage mixer and the first-stage reactor in sequence, and the second route is connected with the stabilization tower directly or indirectly;

wherein the hydrogen gas feed pipeline is divided into at least a first pipeline and optionally a second pipeline, wherein the first pipeline is connected with the first-stage reactor outlet buffer tank, and the second pipeline is connected with the first-stage mixer.

16. The apparatus for selective hydrogenation of butadiene extraction tail gas according to claim 15, wherein a diluent C4 port of the raw material tank is connected with an outlet of the stabilization tower; or wherein a diluent C4 port of the raw material tank is connected with an outlet pipeline of the first-stage reactor outlet buffer tank.

17. The apparatus for selective hydrogenation of butadiene extraction tail gas according to claim 15, further comprising: a blower suction tank, a blower, a liquefaction condenser, a C4 collection tank, a booster pump and a water-washing tower, which are connected in sequence, and wherein a C4 raw material outlet of the water-washing tower is connected with the raw material tank.

18. The apparatus for selective hydrogenation of butadiene extraction tail gas according to claim 15, further comprising: a second-stage feed cooler, a second-stage mixer, a second-stage reactor and a second-stage reactor outlet buffer tank, which are connected in sequence, and wherein the second route of the outlet pipeline of the first-stage reactor outlet buffer tank is connected with the second-stage feed cooler, and the second-stage reactor outlet buffer tank is connected with the stabilization tower.

19. The apparatus for selective hydrogenation of butadiene extraction tail gas according to claim 18, wherein the hydrogen gas feed pipeline is divided into at least a first pipeline and optionally a second pipeline and a third pipeline, wherein the first pipeline is connected with the first-stage reactor outlet buffer tank, the second pipeline is connected with the first-stage mixer, and the third pipeline is connected with the second-stage mixer; and/or wherein the outlet pipeline of the first-stage reactor outlet buffer tank is divided into three routes, further wherein the first route is connected with the circulated C4 cooler, the first-stage mixer and the first-stage reactor in sequence, the second route is connected with the second-stage feed cooler, and the third route is connected with the diluent C4 port of the raw material tank;

wherein the hydrogen gas feed pipeline is divided into at least a first pipeline and optionally a second pipeline and a third pipeline, further wherein the first pipeline is connected with the first-stage reactor outlet buffer tank, the second pipeline is connected with the first-stage mixer, and the third pipeline is connected with the second-stage mixer.

20. The apparatus for selective hydrogenation of butadiene extraction tail gas according to claim 17, wherein the outlet pipeline of the first-stage reactor outlet buffer tank is divided into two routes, wherein the first route is connected with the circulated cooler, the first-stage mixer and the first-stage reactor in sequence, and the second route is connected with the stabilization tower;

optionally, an outlet of the stabilization tower is connected with a diluent C4 port of the blower suction tank;

optionally, the water-washing tower is provided at top with a washing water inlet and a C4 raw material outlet, and provided at bottom with a liquefied C4 raw material inlet and a washing water outlet, and the booster pump is connected with the liquefied C4 raw material inlet.

* * * * *